US007395024B2

(12) United States Patent
Hoshino et al.

(10) Patent No.: US 7,395,024 B2
(45) Date of Patent: Jul. 1, 2008

(54) SHEET PACKAGE, PACKAGE MEMBER AND PRINTER

(75) Inventors: Terumasa Hoshino, Nagoya (JP); Yasunori Nakamura, Shinshiro (JP); Yoko Kimura, Chofu (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 25 days.

(21) Appl. No.: 10/529,726

(22) PCT Filed: Dec. 19, 2003

(86) PCT No.: PCT/JP03/16321

§ 371 (c)(1),
(2), (4) Date: Mar. 30, 2005

(87) PCT Pub. No.: WO2004/056683

PCT Pub. Date: Jul. 8, 2004

(65) Prior Publication Data

US 2005/0271447 A1 Dec. 8, 2005

(30) Foreign Application Priority Data

Dec. 20, 2002 (JP) ..... 2002-369958
Dec. 27, 2002 (JP) ..... 2002-379573

(51) Int. Cl.
*B65H 1/00* (2006.01)
*G03G 15/00* (2006.01)

(52) U.S. Cl. ..... 399/381; 399/393; 271/145

(58) Field of Classification Search ..... 400/624, 400/629, 708; 271/144, 145, 165, 171; 399/361, 399/381, 388, 393; 206/425; *B41J 13/12, B41J 13/10; G03G 15/00*
See application file for complete search history.

(56) References Cited

U.S. PATENT DOCUMENTS

| | | | | |
|---|---|---|---|---|
| 4,915,229 | A * | 4/1990 | Yamada et al. | 206/455 |
| 5,390,793 | A * | 2/1995 | Kausch et al. | 206/455 |
| 5,996,991 | A * | 12/1999 | Dirx et al. | 271/149 |
| 6,227,732 | B1 * | 5/2001 | Higuchi et al. | 400/624 |
| 6,357,739 | B2 | 3/2002 | Sasaki et al. | |
| 6,364,553 | B1 * | 4/2002 | McCue et al. | 400/625 |
| 6,563,525 | B2 * | 5/2003 | Suzuki | 347/218 |
| 6,598,795 | B1 * | 7/2003 | Prenn | 235/462.01 |
| 2003/0164317 | A1 * | 9/2003 | Fujiwara | 206/425 |

FOREIGN PATENT DOCUMENTS

EP 0 517 210 A1 12/1992

(Continued)

*Primary Examiner*—Daniel J. Colilla
*Assistant Examiner*—'Wynn' Q Ha
(74) *Attorney, Agent, or Firm*—Oliff & Berridge, PLC

(57) ABSTRACT

A sheet package which can be loaded in a sheet storage chamber (6) of a printer (1) comprises a stack of sheets (7) as print media for the printer and a package member (8) covering the exterior of the stack of sheets. The package member includes a first portion (53) covering one of upper and lower faces of the stack of sheets, a second portion (52) connecting with the first portion and covering a side face of the stack of sheets, and a third portion (51) connecting with the second portion and covering the other of the upper and lower faces of the stack of sheets. The first portion of the package member includes a first exposing portion exposing part of the stack of sheets to allow the entrance of a sheet feed roller (12) of the printer. The package member includes a second exposing portion exposing a side part of the stack of sheets facing pressing members (61, 64) provided to a side wall (3*b*) of the sheet storage unit of the printer parallel to a sheet feed direction so that the pressing member can press the stack of sheets against a positioning portion provided to the opposite side wall (3*c*) of the sheet storage unit parallel to the sheet feed direction.

16 Claims, 18 Drawing Sheets

FOREIGN PATENT DOCUMENTS

| | | | | |
|---|---|---|---|---|
| EP | 0 703 173 | A2 | | 3/1996 |
| EP | 0 801 017 | A2 | | 10/1997 |
| EP | 0 950 532 | A2 | | 10/1999 |
| EP | 1 491 473 | A1 | | 12/2004 |
| EP | 1 526 100 | A1 | | 4/2005 |
| JP | A-60-097145 | | | 5/1985 |
| JP | A-62-230532 | | | 10/1987 |
| JP | 05330676 | A | * | 12/1993 |
| JP | U-3012401 | | | 4/1995 |
| JP | A-08-062782 | | | 3/1996 |
| JP | 11091957 | A | * | 4/1999 |
| JP | A-11-091958 | | | 4/1999 |
| JP | A-11-240628 | | | 9/1999 |
| JP | A-11-292310 | | | 10/1999 |
| JP | A-2000-128365 | | | 5/2000 |
| JP | A-2000-203725 | | | 7/2000 |
| JP | 2001051379 | A | * | 2/2001 |
| JP | A-2001-139164 | | | 5/2001 |
| JP | 2001206465 | A | * | 7/2001 |
| JP | A-2001-206465 | | | 7/2001 |
| JP | A-2001-253550 | | | 9/2001 |
| JP | 2002229159 | A | * | 8/2002 |
| WO | WO 99/47362 | | | 9/1999 |

* cited by examiner (a)

(b)

SHEET PACKAGE, PACKAGE MEMBER AND PRINTER

TECHNICAL FIELD

The present invention relates to a package member for protecting the exterior of a stack of sheets, a sheet package including the package member, and a printer in which the sheet package is loaded.

BACKGROUND OF THE INVENTION

Sheet packages, allowing the loading of a whole package storing and protecting a stack of sheets into a printer for refilling the printer with sheets, are well known. An example of such a sheet package has been disclosed in Japanese Patent Provisional Publication No.SHO60-97145, for example. According to the Publication, a stack of sheets is preserved in a box-shaped package made of a material like cardboard. The package is provided with a perforated line so that a part of the package making contact with a sheet feed roller can be removed. When the package is loaded in a printer, the user removes the unnecessary part from the package along the perforated line and sets the package directly in the printer.

Some users of sheet packages hope to form an identification part at a prescribed position on such a package member, read information from the identification part with a sensor of the printer when the sheet package is loaded in the printer, and utilize the information for processes executed by the printer. An example of a sheet package having such a configuration has been disclosed in Japanese Patent Provisional Publication No. SHO60-97145. According to the Publication, information on the type of sheets stored in the package member, etc. is indicated by the identification part and the information is read out from the identification part by the printer, by which the control of a print mechanism unit, for example, can be changed depending on the type of the sheets stored in the package member, etc.

DISCLOSURE OF THE INVENTION

However, various problems arise if the positions of the package member and the sheets (stored in the package member) in the printer are not fixed precisely when the sheet package is loaded in the printer. For example, since a package described in Japanese Patent Provisional Publication No.SHO60-97145 is formed to be slightly larger than the sheet in order to facilitate the storing of the sheets in the package, the sheets might not be positioned at a proper sheet feed position inside the package when the package is loaded in the printer and trouble like the so-called skewing (a sheet being fed obliquely toward the print mechanism unit) can occur. On the other hand, if the clearance between the package and the stack of sheets is reduced for preventing the skewing, the storing of the sheets in the package becomes difficult.

There exists a method for preventing the skewing of sheets, in which feeding positions of the sheets are fixed inside the sheet storage unit of the printer. For example, as a method for the positioning of the sheets in a printing device which feeds the sheets loaded in the sheet storage unit with a sheet feed roller one by one, a side face of the stack of sheets is pressed in one direction by a spring member provided to a side part of the sheet storage unit extending in the sheet feed direction so as to press an entire side face of the stack of sheets against an inner wall of the sheet storage unit opposite to the spring member and thereby regulate the positions of the sheets.

However, if such a spring member is placed at a prescribed position in a printer facing a portion of the aforementioned package where an unnecessary part has been removed (i.e. a portion to make contact with the sheet feed roller, etc.) in order to let the spring member directly push the sheets inside the package, the spring member is able to push only a part of the stack of sheets on the upstream side in the sheet feed direction. Therefore, the other part of the stack of sheets on the downstream side in the sheet feed direction is not pushed by the spring member and not positioned at a proper position, by which the sheets can be placed obliquely inside the package and the skewing might occur in the sheet feed operation.

Even if a spring member is provided in order to push also the part of the stack of sheets on the downstream side in the sheet feed direction, the spring member can not directly position the sheets since the side face of the part is covered with the package and the spring member can only push the exterior of the package containing the sheets.

Further, the sheet package described in Japanese Patent Provisional Publication No.HEI11-91958 requires complicated work in the assembly of the sheet package in the manufacturing process since the package member is in the box shape, and in the loading of the package into the printer since the user has to remove the unnecessary part from the package along the perforated line.

Therefore, simplification of the configuration of the package member can be an effective approach. However, if the simplification is carried out improperly, displacement between the top and base of the package member can be caused by force in the sheet feed direction when the sheet package is loaded in the printer. Especially when a sheet is being fed from the package member to the printer for printing, feeding force of the sheet feed roller is transferred to the package member via the sheet being fed, causing the force in the sheet feed direction and the displacement between the top and base of the package member. When an identification part (like the one in Japanese Patent Provisional Publication No.HEI11-91958) is formed on one of the top and base of the package member having the simplified configuration, the identification part shifts from a prescribed position in the printer, causing misidentification of the type of sheet and malfunction of the print mechanism unit.

In regard to the above problems, the present invention has the following advantages. By the present invention, a sheet package, allowing easy storing of the sheets in the package member and positioning of the sheets at a proper position in a printer, is provided.

Among sheet packages allowing a stack of sheets to be loaded in a printer together with the package member, the sheet package in accordance with the present invention simplifies the configuration of the package member while preventing the displacement of the package member relative to the printer even in the sheet feed operation.

Further, a package member for the sheet package and a printer that is loaded with the sheet package are also provided by the present invention.

In accordance with an aspect of the present invention, there is provided a sheet package which can be loaded in a sheet storage unit of a printer, comprising sheets as print media for the printer and a package member covering the exterior of the stack of sheets. The package member includes a first portion covering one of upper and lower faces of the stack of sheets, a second portion connecting with the first portion and covering a side face of the stack of sheets, and a third portion connecting with the second portion and covering the other of the upper and lower faces of the stack of sheets. The first portion of the package member includes a first exposing portion exposing part of the stack of sheets to allow entrance of a sheet feed roller of the printer. The package member includes a second exposing portion exposing a side part of the stack of sheets facing a pressing member provided to a side wall of the sheet storage unit of the printer parallel to a sheet feed direction so that the pressing member can press the stack of sheets against a positioning portion provided to the opposite side wall of the sheet storage unit parallel to the sheet feed direction. There are also provided a package member for the sheet package and a printer employing the sheet package in accordance with other aspects of the present invention.

BEST MODE FOR CARRYING OUT THE INVENTION

Figure 1:
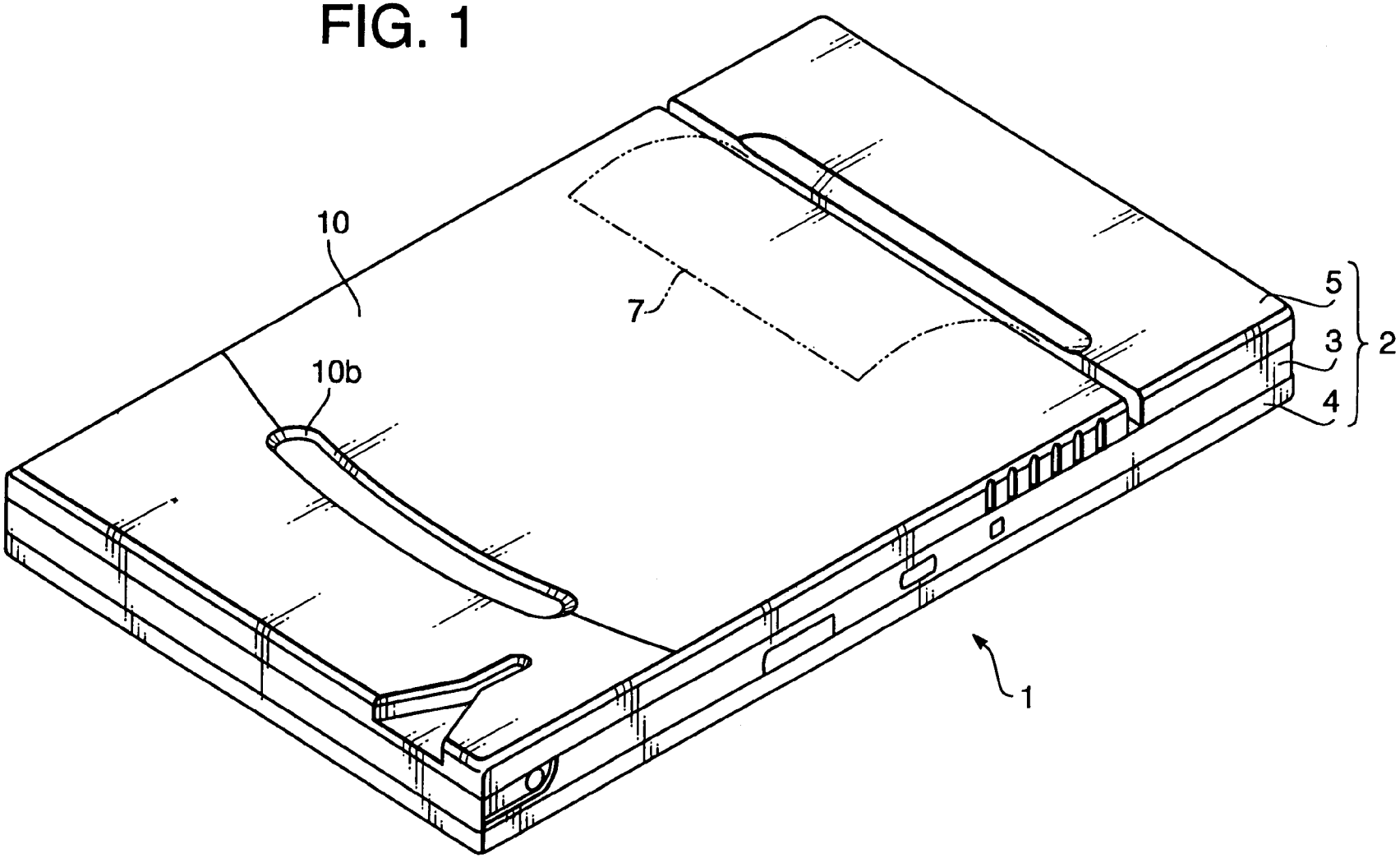
FIG. 1 is a perspective view showing the external appearance of a printer in accordance with an embodiment of the present invention.

Referring now to the drawings, a description will be given in detail of preferred embodiments in accordance with the present invention.

[Composition of Printer]

First, the overall composition of a printer 1 as a thermal recording device will be described referring to FIGS. 1 through 5.

Figure 2:
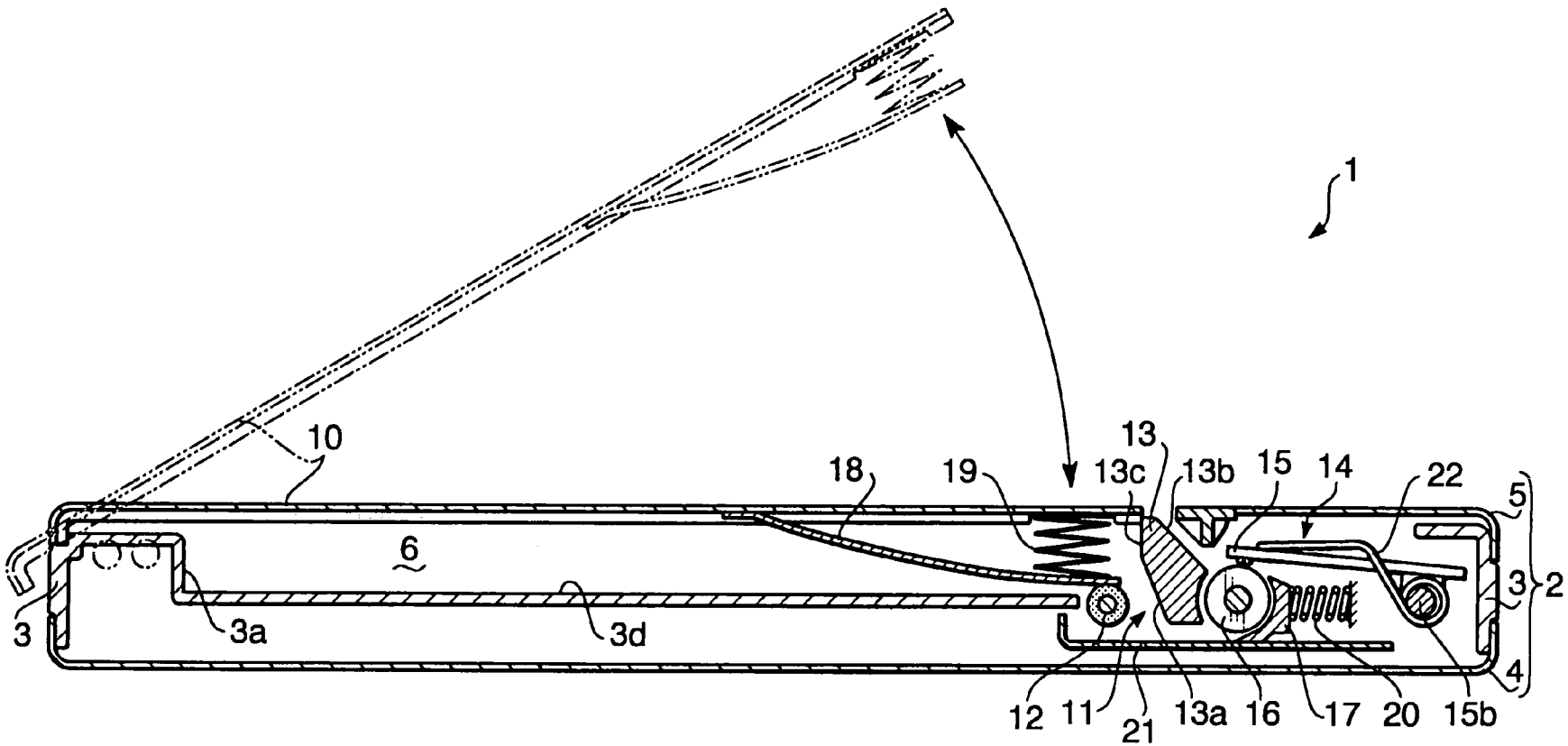
FIG. 2 is a sectional side view of the printer of FIG. 1.
Figure 3:
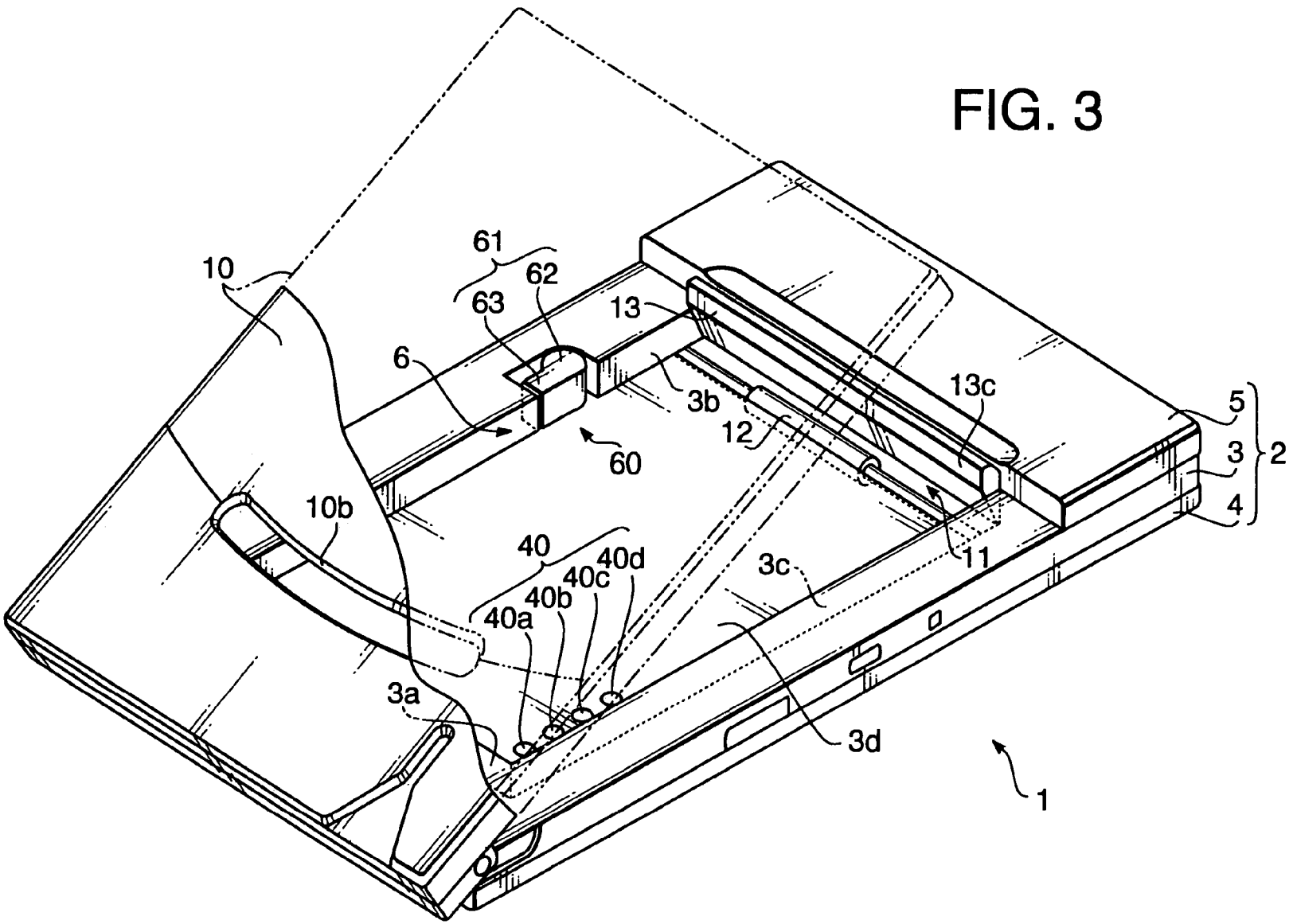
FIG. 3 is a perspective view of the printer of FIG. 1 showing a state in which a lid is opened.
Figure 4:
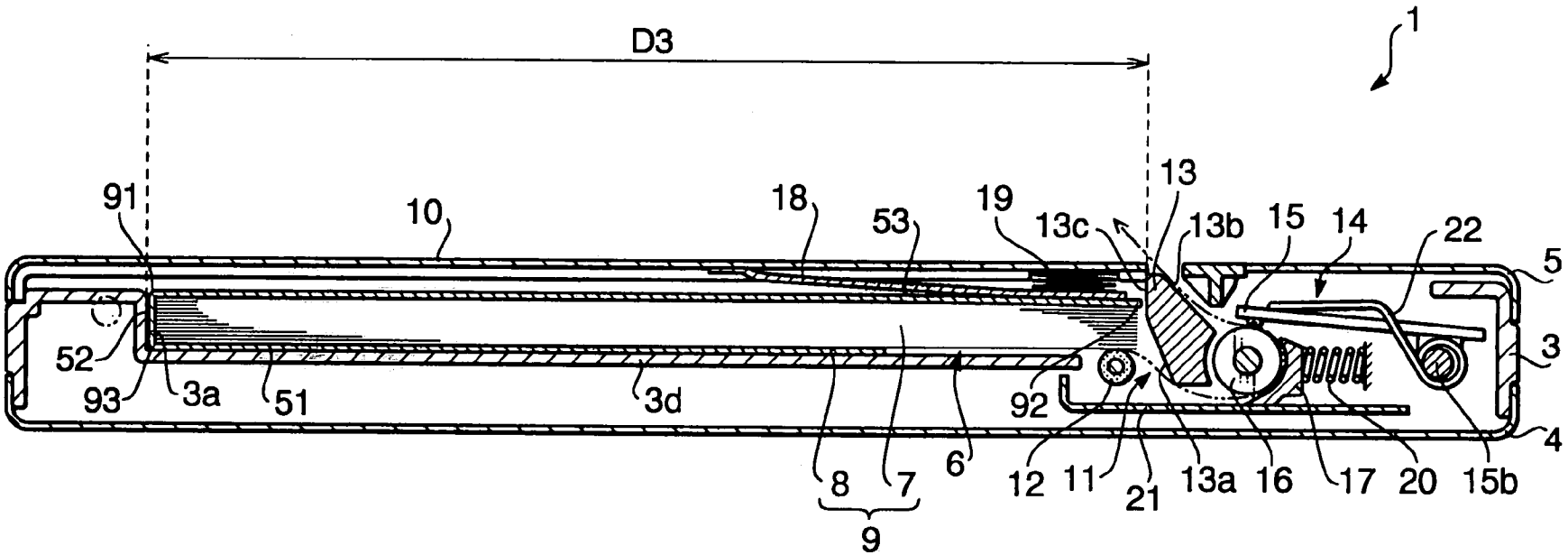
FIG. 4 is a sectional side view showing a state in which a sheet package has been stored in a sheet storage unit of the printer of FIG. 1.
Figure 5:
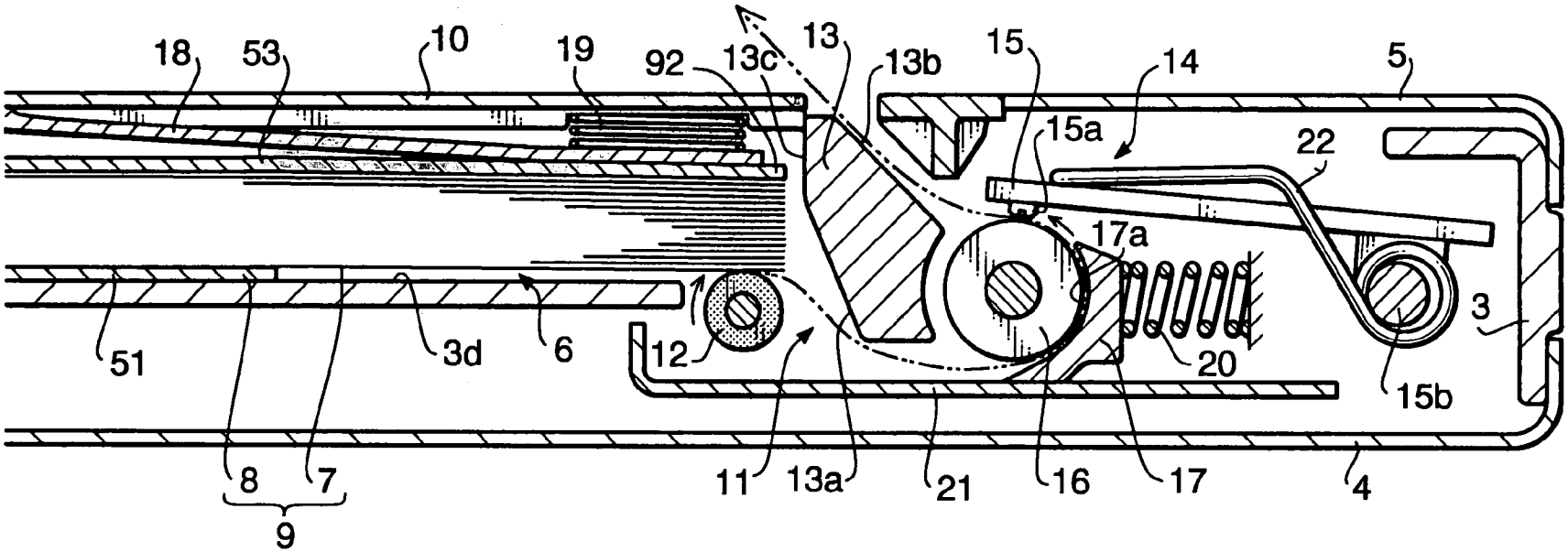
FIG. 5 is an enlarged view showing the details of a sheet separation unit and a print mechanism unit of the printer of FIG. 1.

FIGS. 1 and 2 are a perspective external view and a sectional side view of the printer 1. FIG. 3 is a perspective view of the printer 1 in which part of a lid 10 is broken and seen through. FIG. 4 is a sectional side view showing a state in which sheets have been set in a sheet storage unit. FIG. 5 is an enlarged sectional view showing the details of a sheet separation unit and a print mechanism unit.

As shown in FIG. 1, the printer 1 is designed to be compact in size, with a rectangular shape in a plan view (capable of accommodating sheets of approximately A6-A7 size) and a thickness of approximately 2 cm or less.

A body case 2 of the printer 1 is formed by covering the base of a frame 3 with a lower cover 4 and covering part of the top of the frame 3 with an upper cover 5.

In a part of the top side of the frame 3 that is not covered with the upper cover 5, a sheet storage unit 6 is formed as shown in FIG. 2. In the sheet storage unit 6, a sheet package 9, storing a lot of heat-sensitive cut sheets 7 of A6-A7 size in a package member 8, can be loaded and stored as shown in FIG. 4.

The top of the sheet storage unit 6 is covered with a lid 10 which is rotatable in a direction indicated by an arrow in FIG. 2. Incidentally, a state in which the lid 10 has been opened is shown in FIG. 3 and a state in which the lid 10 has been closed with the sheet package 9 loaded in the sheet storage unit 6 is shown in FIG. 4.

At one end of the sheet storage unit 6, a pickup roller (sheet feed roller) 12, a separation block 13, etc. forming a sheet separation unit 11 are placed. Beneath the upper cover 5, a thermal head 15, a platen roller 16 and a paper guide 17 forming a print mechanism unit 14 (described in detail later) are placed.

As shown in FIG. 3, the sheet storage unit 6 is formed as a rectangular concave part capable of accommodating the sheet package 9. The sheet storage unit 6 is formed of inner side walls surrounding the sheet storage unit 6 and a bottom face 3*d* at the bottom of the sheet storage unit 6. The inner side walls of the sheet storage unit 6 include an inner wall 3*a* situated on the upstream side in the direction in which the sheet 7 is fed by the pickup roller 12 (sheet feed direction), inner walls 3*b* and 3*c* extending in the sheet feed direction, and an inner wall 13*c* situated on the downstream side and forming part of the separation block 13.

The inner wall 3*b* extending in the sheet feed direction is provided with a concave part 60, and a pressing member 61 is placed inside the concave part 60. The pressing member 61 includes a base 62 which is rotatable around a vertical axis 62X and an arm 63 provided integrally with the base 62 (see FIG. 12).

Figure 12:
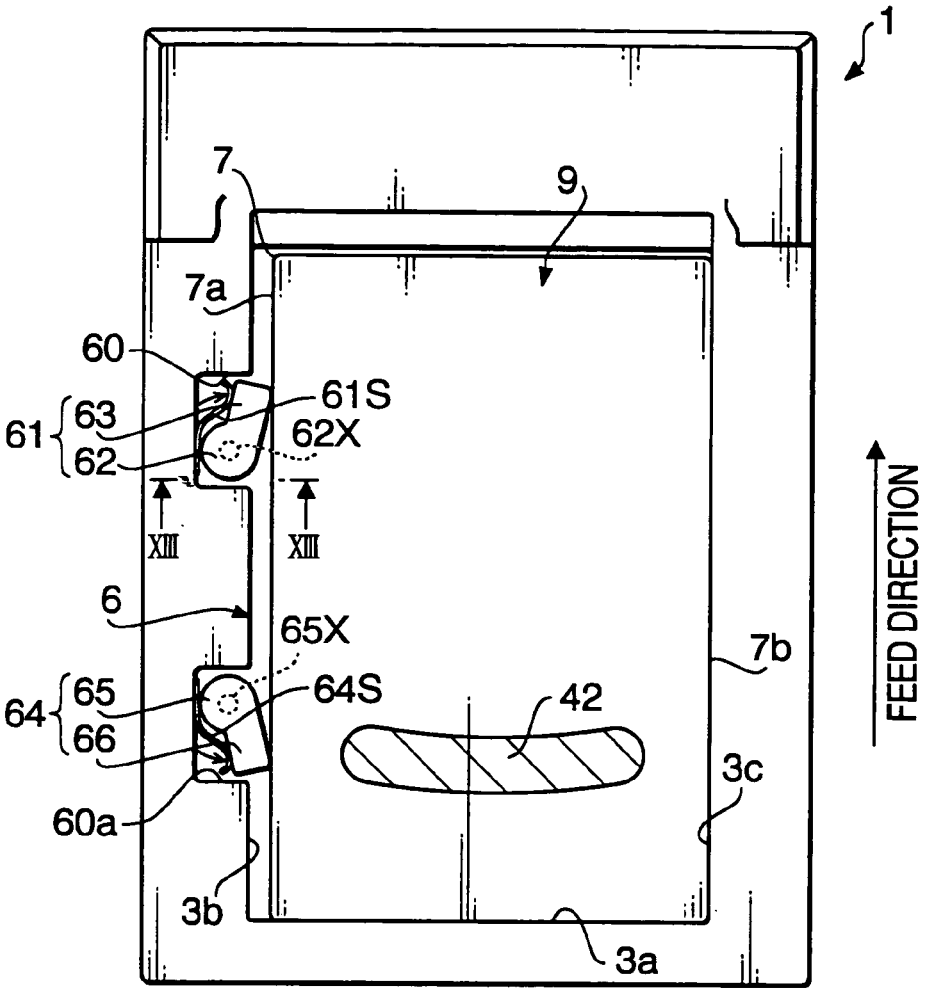
FIG. 12 is a plan view showing a state in which guide members of the printer are pushing edges of sheets.

The base 62 is equipped with a spring 61S which applies biasing force to the arm 63 in a direction letting the arm 63 protrude from the inner wall 3*b* (direction indicated by an arrow in FIG. 12). Therefore, when the sheet package 9 is loaded in the sheet storage unit 6, the arm 63 makes contact with side edges of the sheets 7 in the sheet package 9 and thereby presses the sheets 7 against the other inner wall 3*c* of the sheet storage unit 6, by which the edges of the sheets 7 are evened up and skewing of the sheets 7 is avoided during sheet feeding.

The configuration for pressing the sheet package 9 against the inner wall 3*c* (pressing member 61) is not restricted to the above configuration but can be modified in various ways.

In this embodiment, the inner wall 3*b* is further provided with another concave part 60*a* at a position a certain distance apart from the concave part 60, and a pressing member 64 is placed inside the concave part 60*a*. The pressing member 64 includes a base 65 which is rotatable around a vertical axis 65X and an arm 66 provided integrally with the base 65 (see FIG. 12).

The base 65 is equipped with a spring 64S which applies biasing force to the arm 66 in a direction letting the arm 66 protrude from the inner wall 3*b* (direction indicated by an arrow in FIG. 12). The function of the pressing member 64 is the same as that of the pressing member 61, and thus repeated description thereof is omitted.

As shown in FIG. 3, a reflective sensor (sensor unit) 40 is provided to a part of the bottom face 3*d* beside the inner wall 3*c* and in the vicinity of a corner of the sheet storage unit 6. The reflective sensor 40 includes four sensors 40*a*-40*d* arranged in the sheet feed direction. Each sensor 40*a*-40*d* emits light and detects the amount of reflected light, by which an identification mark (identification part) 41 of the sheet package 9 (explained later) is read.

Next, the sheet separation unit 11 will be explained below. As shown in FIG. 5, the pickup roller 12, the separation block 13 and the print mechanism unit 14 are provided in the vicinity of the inner wall 13*c* of the sheet storage unit 6. On the inner surface of the lid 10, a pressure plate 18 is supported rotatably.

A bias spring 19 is placed between the pressure plate 18 and the lid 10, which constantly exerts biasing force on the pressure plate 18 so as to rotate the pressure plate 18 downward.

The sheet package 9 stores the sheets 7 which have been stacked up with their print surfaces (surfaces to be printed on) facing downward. The sheets 7 are set in the sheet storage unit 6, with the lower surface of the lowermost one of the stacked sheets 7 exposing itself partially from the package member 8. When the lid 10 is closed, the pressure plate 18 biased downward by the aforementioned bias spring 19 presses down a front end part of the sheets 7 (in regard to the sheet feed direction) via the package member 8 (a top board 53 which will be explained later). Consequently, the exposed part of the lowermost sheet 7 makes contact with the pickup roller 12 and pressed by the pickup roller 12 with proper force.

The separation block 13 has a separation guide surface 13*a* which is tilted with respect to the sheet feed direction of the pickup roller 12.

The lowermost sheet 7 contacting the pickup roller 12 is given feeding force by the revolving pickup roller 12. With the separation function of the separation guide surface 13*a* of the separation block 13, only one sheet 7 at the bottom of the stacked sheets 7 is separated and sent out.

The print mechanism unit 14 will be explained below. The platen roller 16 is rotatably provided next to the separation block 13, and the paper guide 17 is placed close to the exterior surface of the platen roller 16.

As shown in the enlarged view of FIG. 5, the paper guide 17 is provided with a sliding surface 17*a* as a concavely curved surface along the exterior surface of the platen roller 16. Between the paper guide 17 and the body case 2, a pressure coil spring 20 is placed so as to press the sliding surface 17*a* against the exterior surface of the platen roller 16.

The sheet 7 separated by the aforementioned sheet separation unit 11 is fed by the pickup roller 12 as indicated by the two-dot chain line in FIG. 5 and thereby passes under the base of the separation block 13. Thereafter, the sheet 7 is guided by a guide plate 21 and fed by the platen roller 16 to change its direction along the platen roller 16.

Specifically, the sheet 7 is guided by the guide plate 21 and fed beneath the platen roller 16 to a gap between the platen roller 16 and the paper guide 17. The sheet 7, sliding between the exterior surface of the platen roller 16 and the sliding surface 17*a* of the paper guide 17, is conveyed upward by the driving force of the revolving platen roller 16 changing its feed direction by 180 degrees. By the above operation, the sheet 7 reaches the top of the platen roller 16 with its print surface facing upward.

The thermal head 15, placed nearby the top of the platen roller 16, includes a heating element unit 15*a*. The thermal head 15 is rotatably supported by a rotation axis 15*b*, by which the heating element unit 15*a* can contact and separate from the top of the platen roller 16.

Incidentally, the thermal head 15 is designed to be rotatable as above in order to make a "paper jam clearance operation" possible when the sheet 7 gets jammed between the platen roller 16 and the paper guide 17.

To the thermal head 15, an end of a spring 22 of a twisting coil spring type is attached. The spring 22 constantly biases the thermal head 15 in a direction letting the heating element unit 15*a* make contact with the top of the platen roller 16.

The sheet 7 is conveyed by the platen roller 16 with its print surface facing upward and the print surface makes contact with the heating element unit 15*a* of the thermal head 15, by which the printing is carried out at the contacting part.

The thermal head 15, formed as a line head, is capable of printing an arbitrary character string or image on the conveyed heat-sensitive sheet 7 in a direction orthogonal to the feed direction of the sheet 7. The printable width of the thermal head 15 is set approximately equal to the width of the sheet 7.

In this embodiment, heat-coloring sheets are employed as the sheets 7. The heat-coloring sheet includes a coloring layer (coloring when heated by the thermal head 15) formed on its one side as an image receiving layer.

On the separation block 13, a sheet ejection guide surface 13*b*, tilted from the sheet feed direction of the platen roller 16 toward the top of the printer 1, is formed.

The sheet 7 after being printed on by the heating element unit 15*a* of the thermal head 15 is guided by the sheet ejection guide surface 13*b* and thereby ejected upward through a gap between the lid 10 and the upper cover 5 of the body case 2, as indicated by two-dot chain lines in FIG. 1.

[Composition of Sheet Package]

Next, the sheet package 9 which is set in the printer 1 in this embodiment will be explained below.

Figure 6:
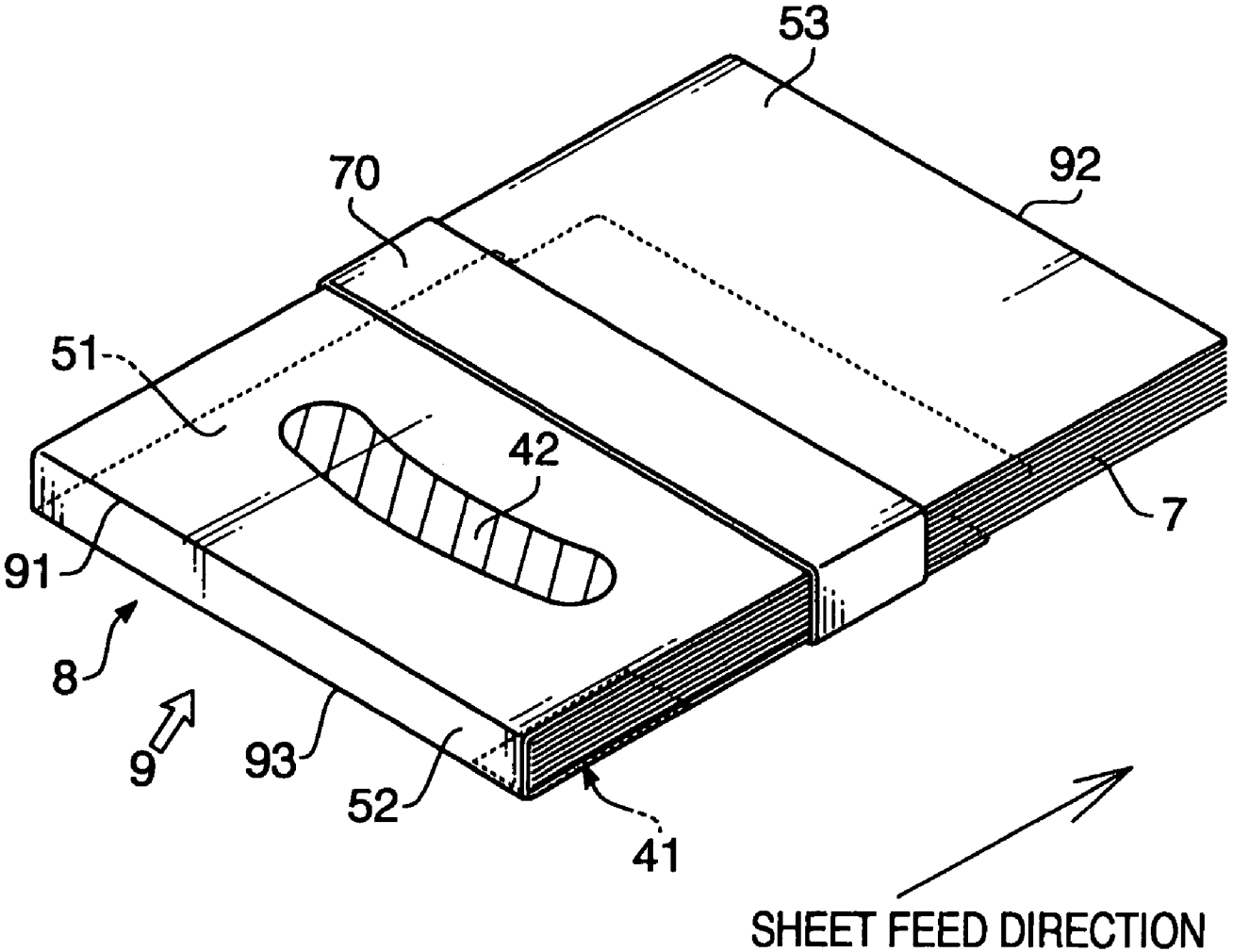
FIG. 6 is a perspective view of a sheet package which is loaded in the printer of FIG. 1.

FIG. 6 is a perspective view of the sheet package 9. As shown in FIG. 6, the sheet package 9 includes the sheets 7 as cut sheets, the package member 8 storing the sheets 7 which have been stacked up, and a long belt-shaped member 70 bundling the package member 8 up.

As the sheets 7, small-sized sheets of approximately A6-A7 size are used, for example. The package member 8 stores approximately 50 sheets therein.

The belt-shaped member 70 is wound around the package member 8 in a direction orthogonal to the sheet feed direction to bundle the package member 8 up. As the belt-shaped member 70, a member having a width ⅓-½ of the length of the sheet 7 in the sheet feed direction is used.

The package member 8 includes a top board 53 having substantially the same (rectangular) shape as the sheet 7, a side board 52 connecting with the top board 53, and a base board 51 connecting with the side board 52. Specifically, out of two edges 91 and 92 of the top board 53 orthogonal to the sheet feed direction, an edge 91 on the upstream side connects with the side board 52, and an edge 93 of the side board 52 (opposite to the edge 91 connecting with the top board 53) connects with the base board 51, by which the base board 51, the side board 52 and the top board 53 are formed integrally.

Figure 7:
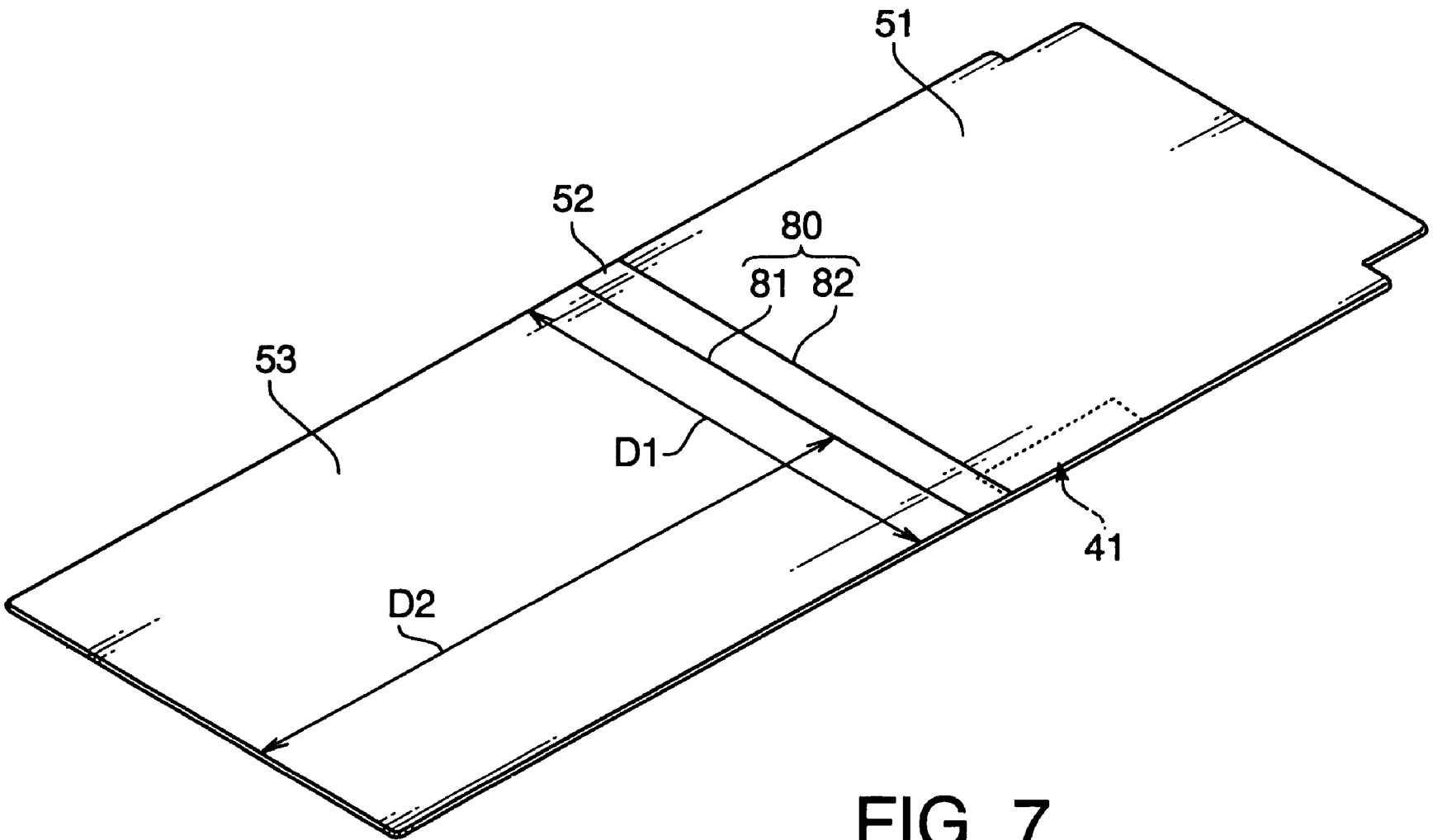
FIG. 7 is a developed view of a package member forming the sheet package of FIG. 6.

FIG. 7 is a developed view of the package member 8, in which the package member 8 before being folded is shown. The package member 8 shown in FIG. 6 is obtained by folding a flat cardboard material shown in FIG. 7 into a shape like "U".

The package member 8 is designed to have a dimension D1 in its width direction substantially equal to the width of the sheet 7. The details will be explained later.

The package member 8 is provided with creases. The creases 80 are formed at the boundaries between the base board 51 and the side board 52 and between the side board 52 and the top board 53.

The top board 53 of the package member 8 of this embodiment is configured so that its dimension D2 in the sheet feed direction will be substantially equal to the distance D3 (see FIG. 4) between the inner walls 3*a* and 13*c* of the sheet storage unit 6. With this configuration, when the sheet package 9 is loaded in the sheet storage unit 6, the edges 91 and 92 of the top board 53 on the upstream/downstream sides in the sheet feed direction make contact with the inner walls 3*a* and 13*c* respectively as shown in FIG. 4. By the contact of the edges 91 and 92 with the inner walls 3*a* and 13*c*, the package member 8 is positioned correctly in the sheet feed direction. The details will be explained later.

The top board 53 of the package member 8 is provided with a display part 42 to be checked by the user through a display window 10*b* of the printer when the sheet package has been set in the sheet storage unit 6. On the display part 42, the type of the sheet 7 stored in the package member 8 (heat-sensitive paper of a normal type, heat-sensitive paper capable of gaining two colors, label paper including a label sheet formed on a strippable sheet to be peeled from the strippable sheet after printing and used as a label that can be stuck on objects, duplicate paper allowing simultaneous printing on two sheets, etc.) is indicated by a well-known method such as printing.

Meanwhile, the base board 51 of the package member 8 is formed to be shorter than the top board 53 in the sheet feed direction so as to allow the entrance of the pickup roller 12 into the package. The base board 51 is designed to be shorter than the top board 53 by a minimum length that is necessary for the entrance of the pickup roller 12 into the package, since setting the dimension of the base board 51 unnecessarily short can impair the function of the package member 8 for protecting the sheets 7.

The base board 51 has the identification mark 41 at a corner of its under surface (opposite to the sheets 7) on the upstream side in the sheet feed direction as shown in FIG. 6. The identification mark 41 is formed by a well-known method such as printing so that the identification mark 41 will be situated in a reading area of the reflective sensor 40 when the sheet package 9 is set in the sheet storage unit 6.

Figure 9:
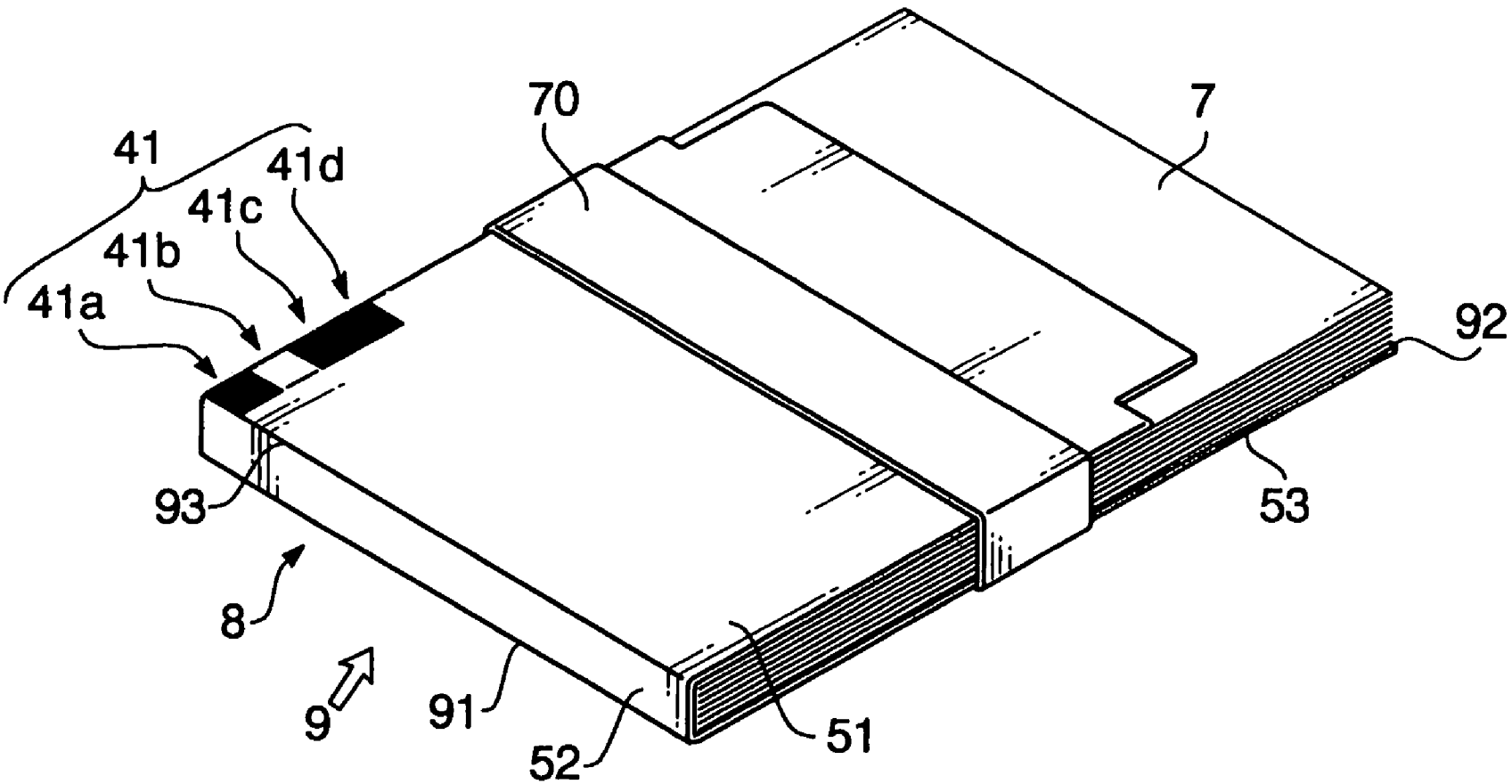
FIG. 9 is a perspective view showing the sheet package of FIG. 6 turned upside down.

FIG. 9 is a perspective view showing the sheet package 9 of FIG. 6 turned upside down. The identification mark 41 is composed of four rectangular indicator bits 41*a*-41*d*. In this embodiment, among the four indicator bits, 0-3 bits are colored black and the remaining bits are not colored (left in the color (white) of the foundation of the package member 8). Concretely, the indicator bits 41*a*, 41*c* and 41*d* are colored black, while the remaining bit 41*b* is left white.

The above black/white pattern has been preset depending on the type of the sheet 7 stored in the package member 8.

[Assembly of Sheet Package]

A process for assembling the sheet package 9 will be described below.

Figure 8:
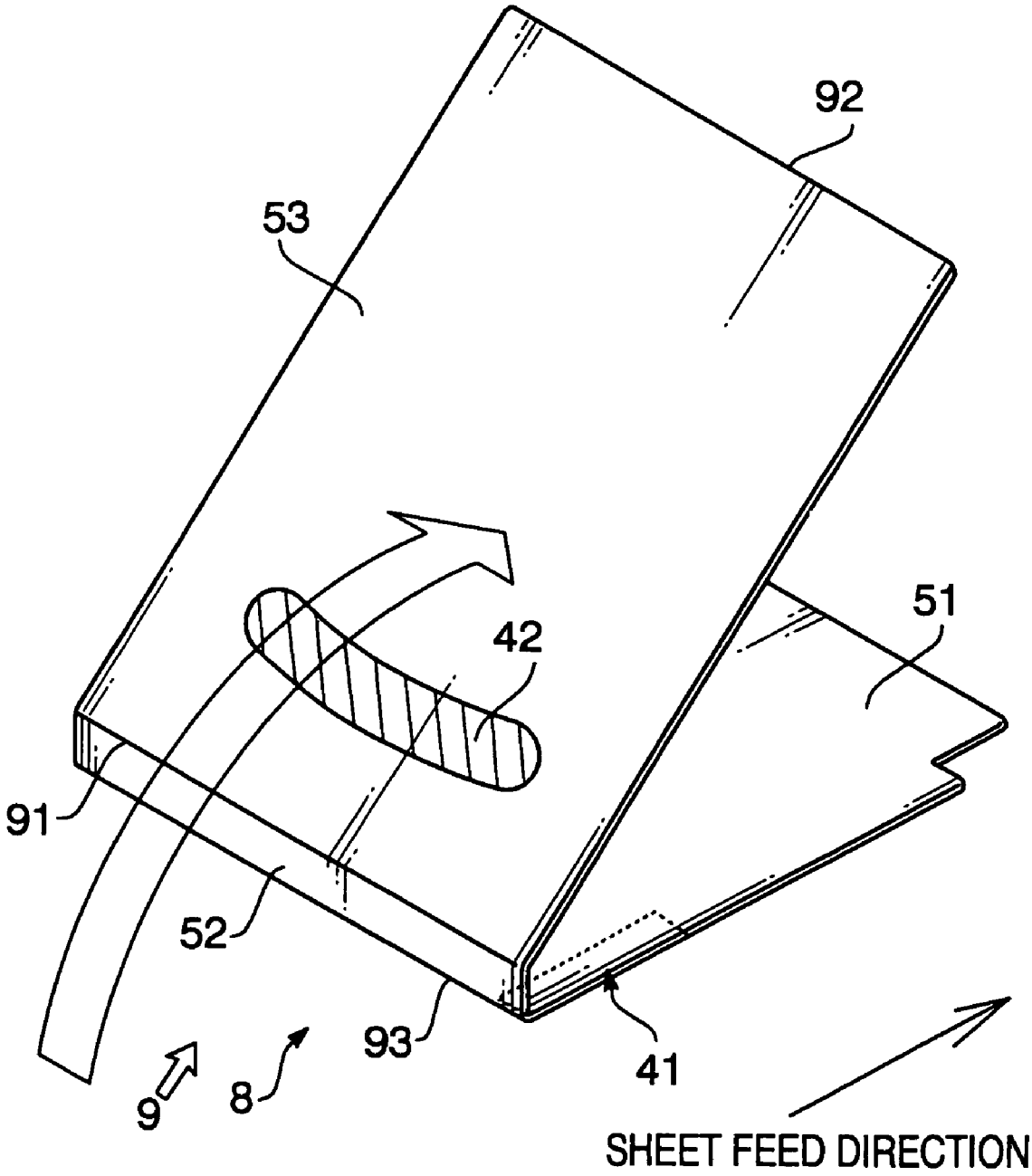
FIG. 8 is a perspective view showing the package member of FIG. 7 being folded and assembled into the package member shown in FIG. 6.

Starting from the package member 8 in the state of FIG. 7, the side board 52 is vertically folded at a crease 82 to be orthogonal to the base board 51 as shown in FIG. 8, and the top board 53 is vertically folded at a crease 81 to be orthogonal to the side board 52. Since the top board 53 and the base board 51 are vertically folded relative to the side board 52, the top board 53 and the base board 51 face each other and the package member 8 is formed into a shape like "U".

Subsequently, the sheets 7 which have been stacked up are sandwiched and stored between the base board 51 and the top board 53 of the package member 8 in the U-like shape.

When the sheets 7 are stored in the package member 8, the direction of each sheet 7 has been preset so that the print surface (a surface to be printed on) of each sheet 7 will face toward the base board 51. The direction is preset as above in order to let the print surface of each sheet 7 face the thermal head 15 when the sheet package 9 is loaded in the printer 1 and the sheet 7 is fed to the print mechanism unit 14.

Finally, the belt-shaped member 70 is wound around the package member 8 (sandwiching and storing the sheets 7) in a direction orthogonal to the sheet feed direction to bundle the sheet package 9 up.

As above, the sheet package 9 is assembled in a relatively easy process, by which the sheet package 9 shown in FIG. 6 is completed.

In this embodiment, the above process for assembling (manufacturing) the sheet package 9 is carried out by a manufacturer. The user of the printer 1 purchases the sheet package 9 sold in the state of FIG. 6 and uses the sheet package 9 by loading it into the printer 1.

[Loading Sheet Package in Printer]

First, the belt-shaped member 70 wound around the package member 8 is removed.

Figure 10:
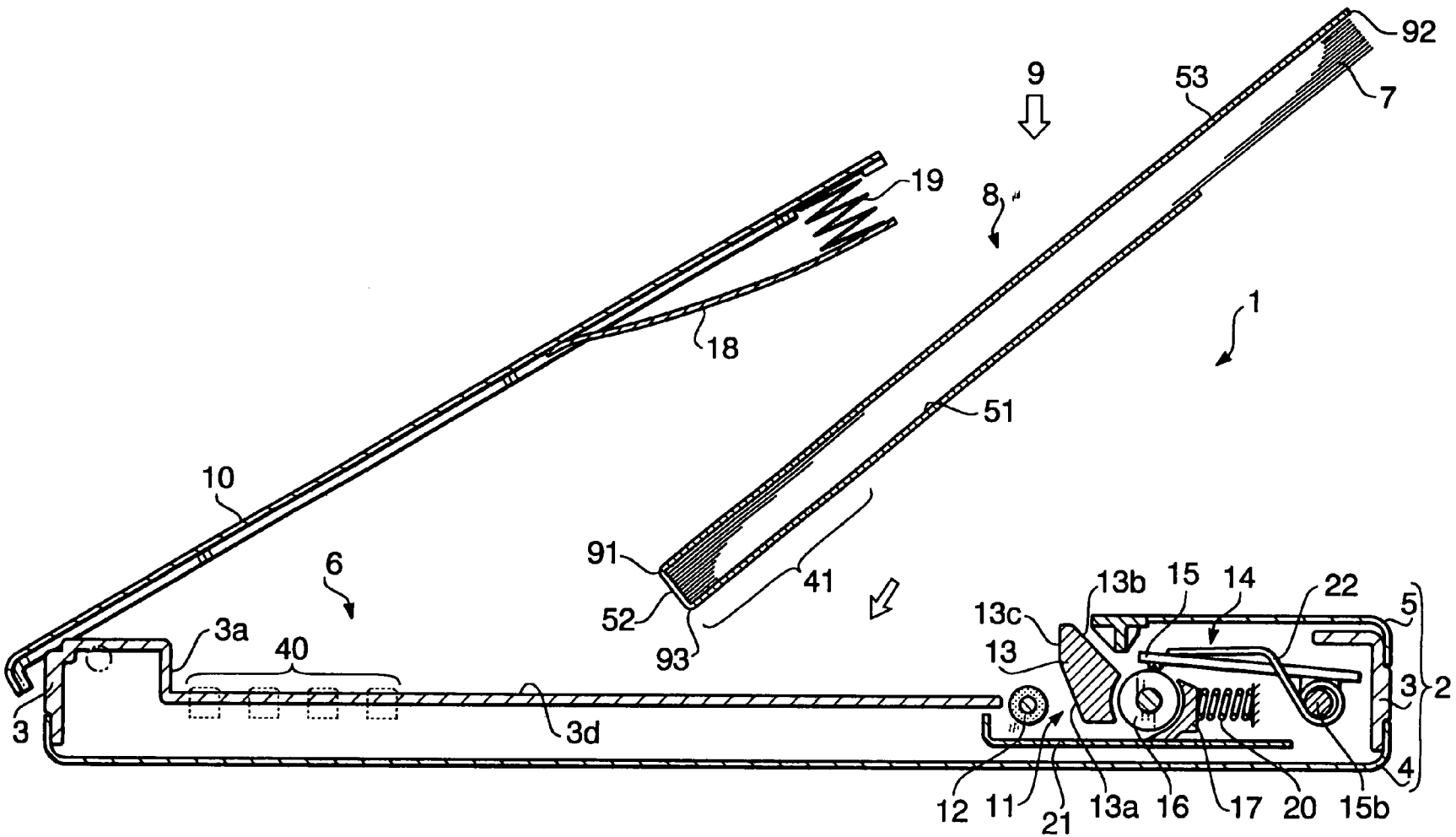
FIG. 10 is a sectional side view showing the loading of the sheet package (from which a belt-shaped member has been removed) into the printer.

Subsequently, the sheet package 9 is loaded into the sheet storage unit 6 of the printer 1 with the base board 51 facing downward as shown in FIG. 10.

Consequently, the exposed part of the lowermost one of the sheets 7 stacked up and stored in the package member 8 makes contact with the top of the pickup roller 12. Therefore, by driving and revolving the pickup roller 12, the sheet 7 can be sent out and conveyed.

Incidentally, the lid 10 of the printer 1 is designed to be opened and closed on the downstream side in the sheet feed direction. When the sheet package 9 is loaded into the printer 1 having such composition, the sheet package 9 is generally tilted as shown in FIG. 10 with the front end (on the upstream side in the sheet feed direction) positioned lower than the rear end.

In the sheet package 9 of this embodiment, the side board 52 of the package member 8 is placed on the upstream side in the sheet feed direction, and thus the state of storage of the sheets 7 can be maintained by the side board 52. Therefore, the sheets 7 stored in the package member 8 are prevented from slipping down from the package member 8 and being scattered about (out of carelessness of the user) when the sheet package 9 is loaded into the sheet storage unit 6. Further, the tilting of the sheet package 9 lets the edges of the sheets 7 make contact with the side board 52, by which the edges of the sheets 7 stacked up are evened up at a prescribed position, preventing trouble like a paper jam from occurring.

Figure 11:
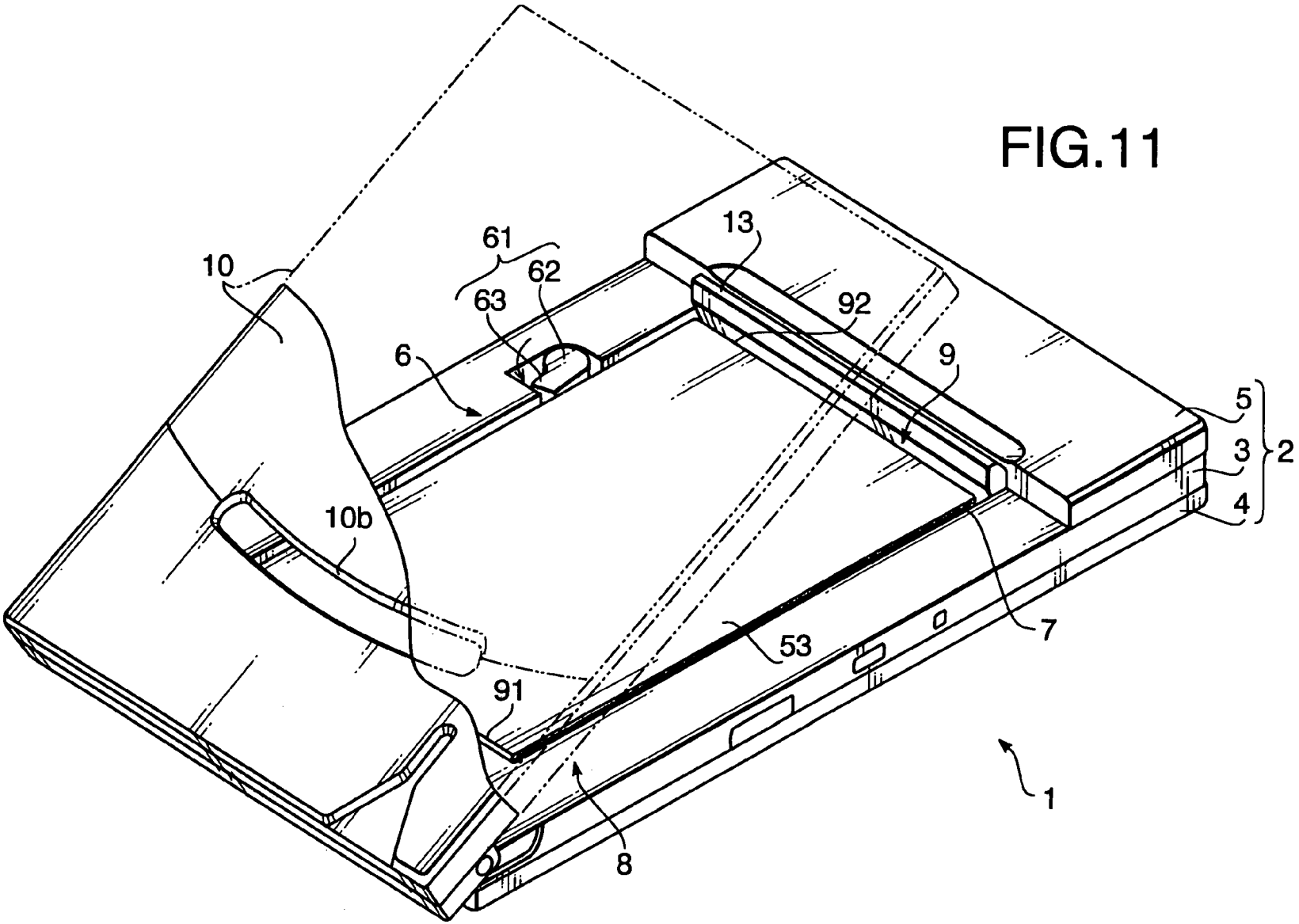
FIG. 11 is a perspective view showing a state in which the sheet package shown in FIG. 10 has been stored in the printer.

FIG. 11 shows a state in which the sheet package 9 has been completely stored in the sheet storage unit 6. In this state, the pressing member 61 in the sheet storage unit 6 rotates in the direction of the arrow shown in FIG. 11 and the arm 63 pushes side edges of the sheets 7. Similarly, the pressing member 64 (see FIG. 12) also rotates and the arm 66 pushes edges of the sheets 7 on the same side.

Figure 13:
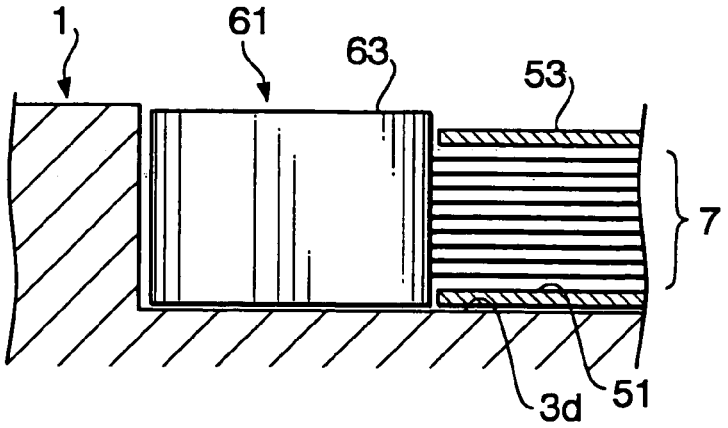
FIG. 13 is a cross-sectional view taken along the line XIII-XIII shown in FIG. 12.

FIG. 12 shows a state in which the arm 63 of the pressing member 61 and the arm 66 of the pressing member 64 are making contact with the sheets 7 and letting a side face of the sheet package 9 contact the inner wall 3*c* of the sheet storage unit 6. FIG. 13 is a cross-sectional view taken along the line XIII-XIII shown in FIG. 12. As shown in FIG. 12, the arms 63 and 66 are pushing the edges 7*a* of the sheets 7 at two positions on the upstream side and downstream side in the sheet feed direction. By pushing the edges 7*a* of the sheets 7 at two positions, the sheets 7 can be moved in a mass.

The dimension D1 of the package member 8 in its width direction (see FIG. 7) is designed to be substantially equal to the width of the sheet 7. Therefore, the pressing member 61 can make contact with side edges of the sheets 7 without being obstructed by part of the package member 8 covering the exterior of the sheets 7, by which the sheets 7 can be aligned along the inner wall 3*c* on the other side of the sheet storage unit 6.

Incidentally, while the dimension (D1 in FIG. 7) of the package member 8 in its width direction is set substantially equal to the width of the sheet 7 in this embodiment, the dimension D1 may also be set shorter than the width of the sheet 7. However, it is desirable to set the width of the package member 8 equal to that of the sheet 7 since the print surfaces of the sheets 7 can be protected securely and edges of the sheets 7 stacked up in the sheet package 9 can be evened up easily by registering the edges of the sheet 7 with an edge of the package member 8.

A state in which the lid 10 has been closed after the loading of the sheet package 9 into the sheet storage unit 6 is shown in FIGS. 4 and 5. In this state, the top board 53 of the package member 8 is situated between the pressure plate 18 (for pressing the sheets 7 against the pickup roller 12) and the sheets 7.

The sheets 7 are set in the printer 1 while being stored in the sheet package 9. When all the sheets 7 in the sheet package 9 are used up, the user pulls out the empty package member 8 from the sheet storage unit 6, inserts a new stack of sheets 7 into the package member 8 (made of the base board 51, the side board 52 and the top board 53) letting the print surfaces of the sheets 7 face toward the base board 51, and sets the refilled sheet package 9 in the printer 1, by which printing becomes possible again. It is also possible to discard the empty package member 8 pulled out from the printer 1 and load a brand-new sheet package 9 into the sheet storage unit 6. As above, in this embodiment, the sheets 7 are loaded in the printer necessarily in the state being stored in the package member 8, which is advantageous in that the sheet separation function of the pickup roller 12 and the separation block 13 does not deteriorate even when the printer 1 has printed on a great number of sheets.

Here, let us consider a case where the stack of sheets 7 makes direct contact with the pressure plate 18 not via the top board 53. In this case, the pressure plate 18 wears off in the continuous use of the printer 1 and the friction between the pressure plate 18 and the stack of sheets 7 decreases, by which the separation function is lost and the multi feeding (feeding two or more sheets 7 at once) is caused frequently. In the configuration of this embodiment, the stack of sheets 7 makes direct contact with the top board 53, which is replaced together with the package member 8 each time when a prescribed number of sheets 7 are used up. Therefore, the friction between the top board 53 and the stack of sheets 7 does not drop even in the continuous use of the printer 1 over the years, by which an excellent separation function is maintained consistently and sheet feed trouble (multi feeding, etc.) is prevented from occurring.

[Method for Positioning Package Member in Printer]

Next, a method for correctly positioning the package member 8 of the heet package 9 in the printer 1 (in order to let the reflective sensor 40 of the printer 1 read the identification mark 41 of the package member 8) will be explained below.

In regard to the width direction of the sheet package 9, the dimension D1 (see FIG. 7) of the package member 8 in the width direction is set substantially equal to the width of the sheet 7 as mentioned above. Therefore, the sheets 7 are pushed by the pressing members 61 and 64 (provided to the inner wall 3*b* of the printer 1) against the inner wall 3*c* on the other side, while the package member 8 is also pushed by the pressing members 61 and 64 and positioned in the sheet storage unit 6.

Meanwhile, in the lengthwise direction of the sheet package 9 (i.e. in the sheet feed direction), the dimension D2 (see FIG. 7) of the top board 53 of the package member 8 in the sheet feed direction is set substantially equal to the distance D3 (see FIG. 4) between the inner walls 3*a* and 13*c* of the sheet storage unit 6. Therefore, the edges 91 and 92 of the top board 53 on the upstream/downstream sides in the sheet feed direction make contact with the inner walls 3*a* and 13*c* of the sheet storage unit 6 respectively, by which the package member 8 is positioned in the sheet storage unit 6.

By the positioning of the package member 8 in the width direction and in the sheet feed direction, the four indicator bits 41*a*-41*d* of the identification mark 41 are situated in the reading areas of the four reflective sensors 40*a*-40*d* respectively, by which the reflective sensor 40 is allowed to read the black/white pattern of the indicator bits 41*a*-41*d* correctly and judge the type of the sheet 7.

By the way, the sheet feed operation by the pickup roller 12 generally involves the following problem. When the feeding force is applied to the lowermost sheet 7 making contact with the pickup roller 12, the package member 8 also receives force in the sheet feed direction due to the friction between the lowermost sheet 7 and the base board 51.

Figure 14:
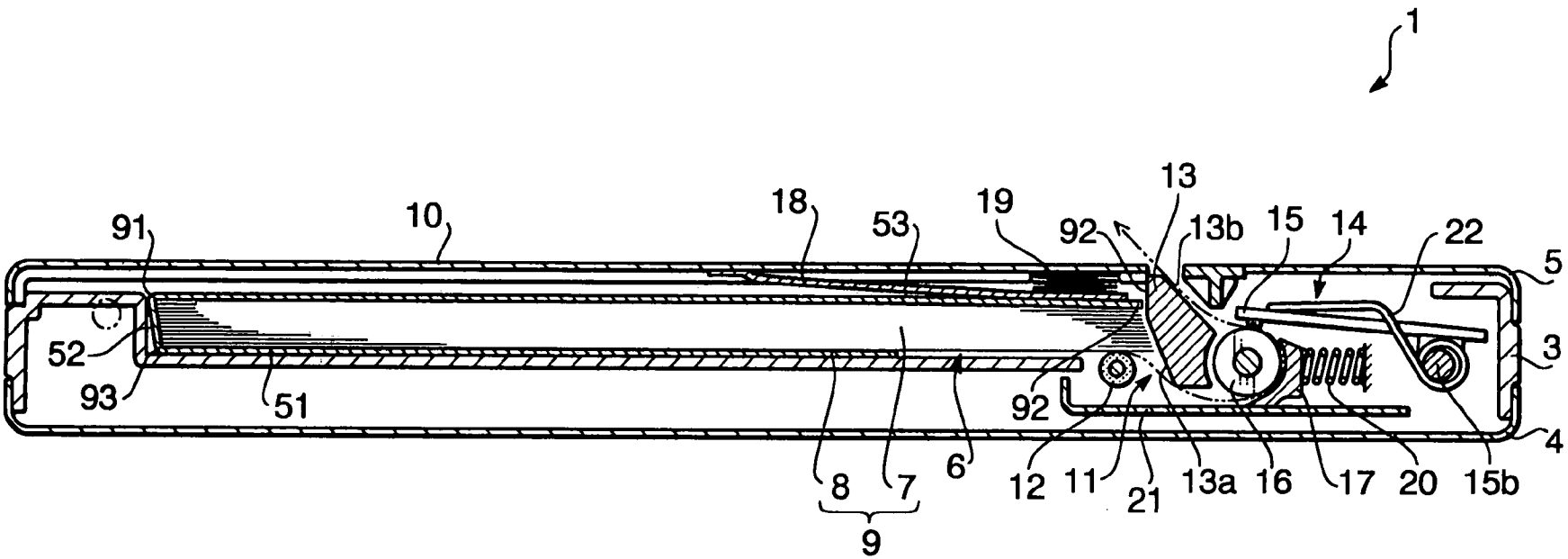
FIG. 14 is a sectional side view showing a state in which a sheet is fed out of the sheet package stored in the printer.

In this embodiment, even in the sheet feed operation, the edge 92 of the top board 53 (on the downstream side in the sheet feed direction) makes contact with the inner wall 13*c* of the sheet storage unit 6, by which the movement of the package member 8 can be restricted against the feeding force from the pickup roller 12. Therefore, even though the side board 52 or the base board 51 connecting with the top board 53 might shift slightly in the sheet feed direction as shown in FIG. 14, the identification mark 41 on the package member 8 can be situated within a readable range of the reflective sensor 40 of the printer 1.

In order to let the identification mark 41 on the base board 51 be positioned at and read by the reflective sensor 40 by letting the package member 8 withstand the feeding force of the pickup roller 12, the difference between the dimension D2 of the top board 53 in the sheet feed direction and the distance D3 between the inner walls 3*a* and 13*c* of the sheet storage unit 6 of the printer 1 has to be within a permissible range of 1.0 mm. Taking a printing error (occurring when the identification mark 41 is printed on the package member 8), etc.

into consideration, the dimension difference 1.0 mm is the limit value allowing the reflective sensor 40 to read the identification mark 41.

[Modifications]

While the above description has been given of an embodiment of the present invention, the technical scope of the present invention is not to be restricted by the above particular illustrative embodiment. Various modifications, design changes, etc. can be made to the embodiment without departing from the scope and spirit of the present invention.

For example, the sheet package 9 may be composed of the sheets 7 and the package member 8 only, without employing the belt-shaped member 70.

By leaving out the belt-shaped member 70 from the composition of the sheet package, manufacturing cost can be reduced correspondingly.

The sheet 7 employed for the sheet package 9 may also be a heat-perforated sheet including a perforation layer (perforated by heat) as an image receiving layer stacked on a base layer. Not only heat-sensitive sheets but also other types of sheets (thermal transfer sheets, etc.) can be used as the sheets 7.

The package member 8 may also be formed by preparing the top board 53, the side board 52 and the base board 51 separately and thereafter connecting them together.

The base board 51 of the package member 8 may also be configured substantially in the same dimension in the sheet feed direction as the top board 53 as long as the pickup roller 12 can enter the package and feed the sheets 7. For example, in cases where the width of the pickup roller 12 is smaller than that of the sheet 7, a cutout part having a width allowing the entrance of the pickup roller 12 into the package may be formed in an end part of the base board 51 in the sheet feed direction.

The configuration of the identification mark 41 formed on the base board 51 of the package member 8 is not restricted to the black/white pattern of the rectangular indicator bits made by printing. The identification mark 41 may also be configured by forming holes at proper positions of the package member 8 to indicate information by a pattern of the presence/absence of holes, for example. The identification mark 41 may also indicate information other than the type of the sheet 7. The point is that some information is indicated to be recognizable to a sensor of the printer.

Figure 18:
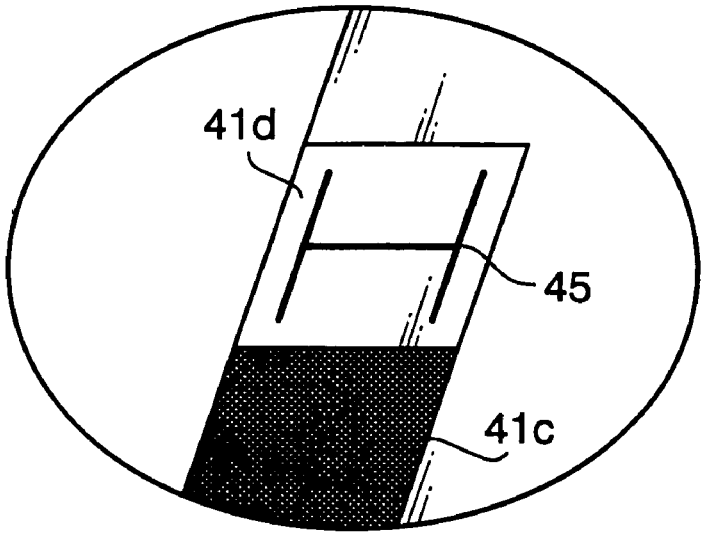
FIG. 18 is a partial enlarged view showing an identification part in which an identification mark is used for positioning the sheet package in the printer.
Figure 18:
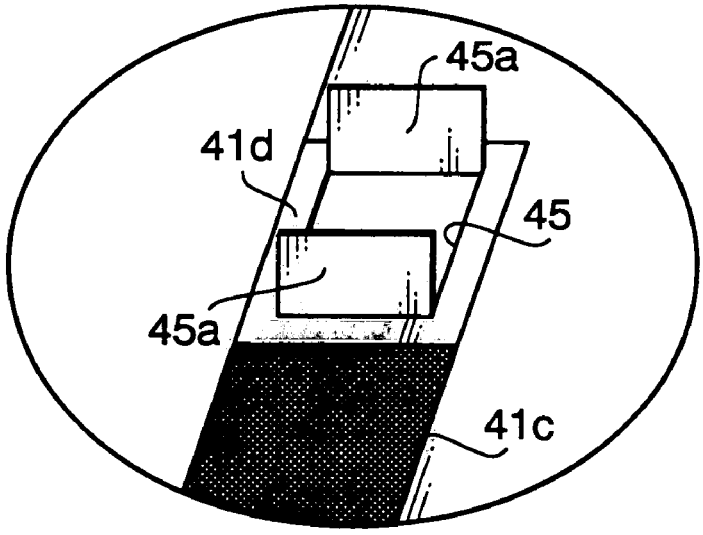
Figure 19:
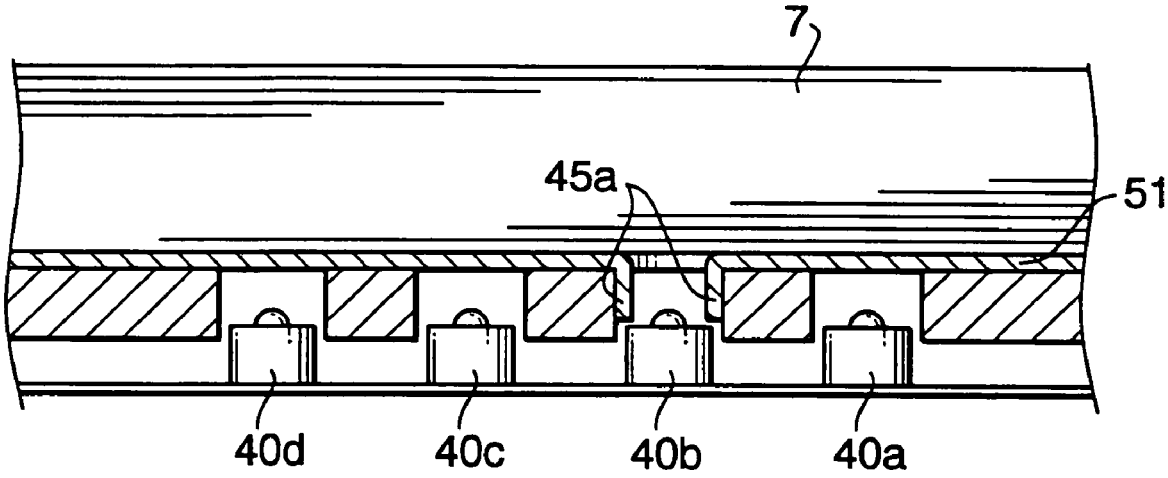
FIG. 19 is a partial sectional view showing a state in which a sheet package having tabs in its identification part has been set in the printer.

It is also possible to make a cut (for the positioning) into the identification mark 41 printed on the base board 51 of the package member 8 in order to securely fix the position of the sheet package 9 when the sheet package 9 is set in the sheet storage unit 6. Specifically, as shown in FIG. 18(*a*), a cut (positioning cut) 45 in the shape of "H" may previously be made into a white part of the identification mark 41 printed on the base board 51 of a package member 8 like the one shown in FIG. 9 (in FIG. 18, a numeral 41*d* denotes the white part). In the loading of the sheet package 9 into the printer 1, the user folds tabs 45*a* outward from the cut 45 as shown in FIG. 18(*b*) and securely positions the sheet package 9 in the printer 1 by engaging the folded tabs 45*a* with a part of the printer 1 for a corresponding sensor 40*b* of the reflective sensor 40 (see FIG. 19).

With such a configuration, the positioning can be achieved by the identification part, by which the type of the sheet package 9 (the type of the sheet 7) can be identified correctly and the printing can be carried out properly. In this case, an opening 46 remains in the part of the package member 8 where the tabs 45*a* were folded outward; however, the reflective sensor 40 can judge the type of the sheet 7 correctly since the color of the sheet 7 is also white.

The printer 1 may also be configured to carry out printing with a means other than the thermal head 15. When the printer is allowed to be a little larger, other printing means like an ink jet printing head may be employed, for example.

The sensor 40 of the printer 1 is not restricted to the reflective sensor 40. Any appropriate sensor can be employed irrespective of whether it is of a contact type or non-contact type.

While the package member 8 in the above embodiment is composed of three consecutive parts (the base board 51, the side board 52 and the top board 53), the package member 8 is not limited to such a configuration. For example, the package member 8 may further include a side board 54 covering the whole side edge 7*b* of the stack of sheets 7 facing the inner wall 3*c* of the sheet storage unit 6 of the printer 1, as shown in FIG. 15.

Figure 15:
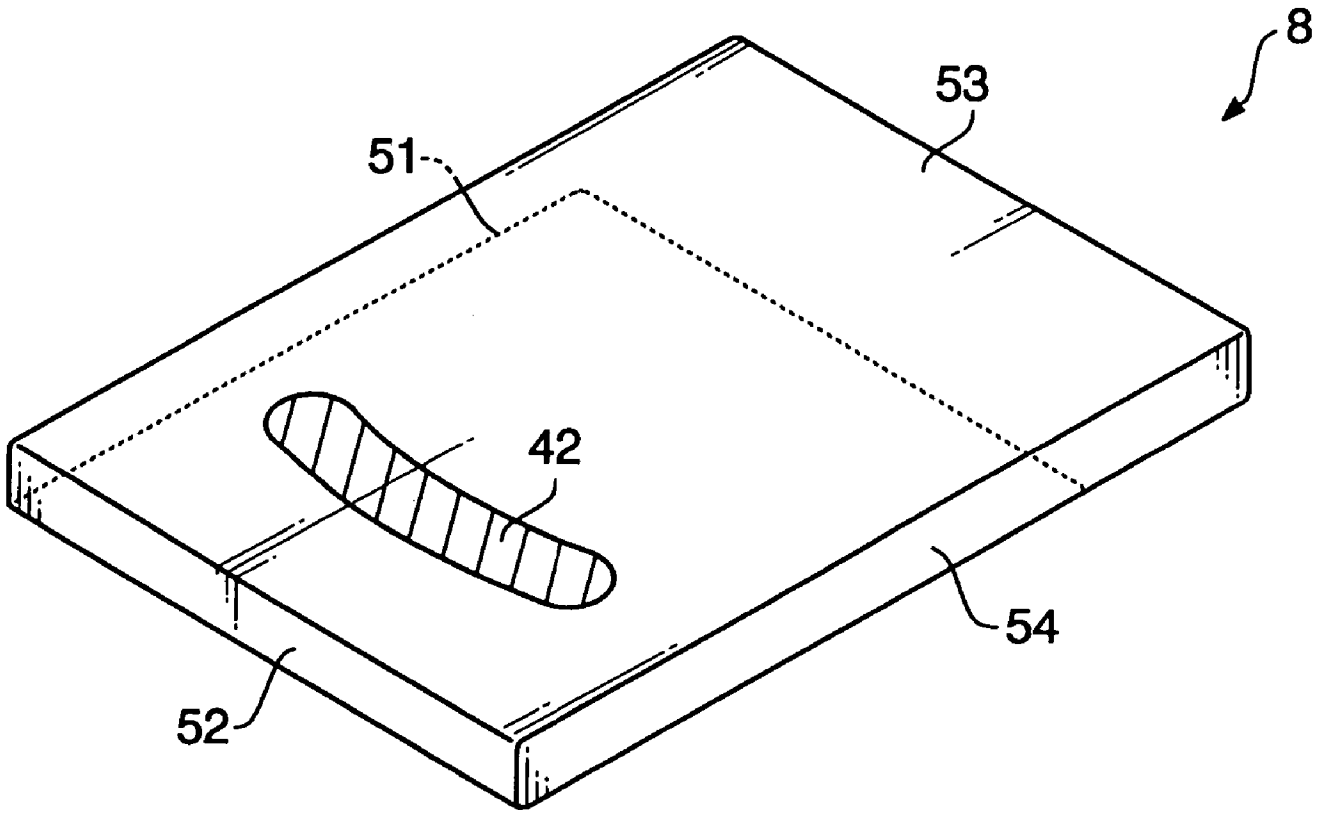
FIG. 15 is a perspective view showing a modification of the sheet package in which a side board is further provided for covering a side edge of the stack of sheets extending in the sheet feed direction.
Figure 16:
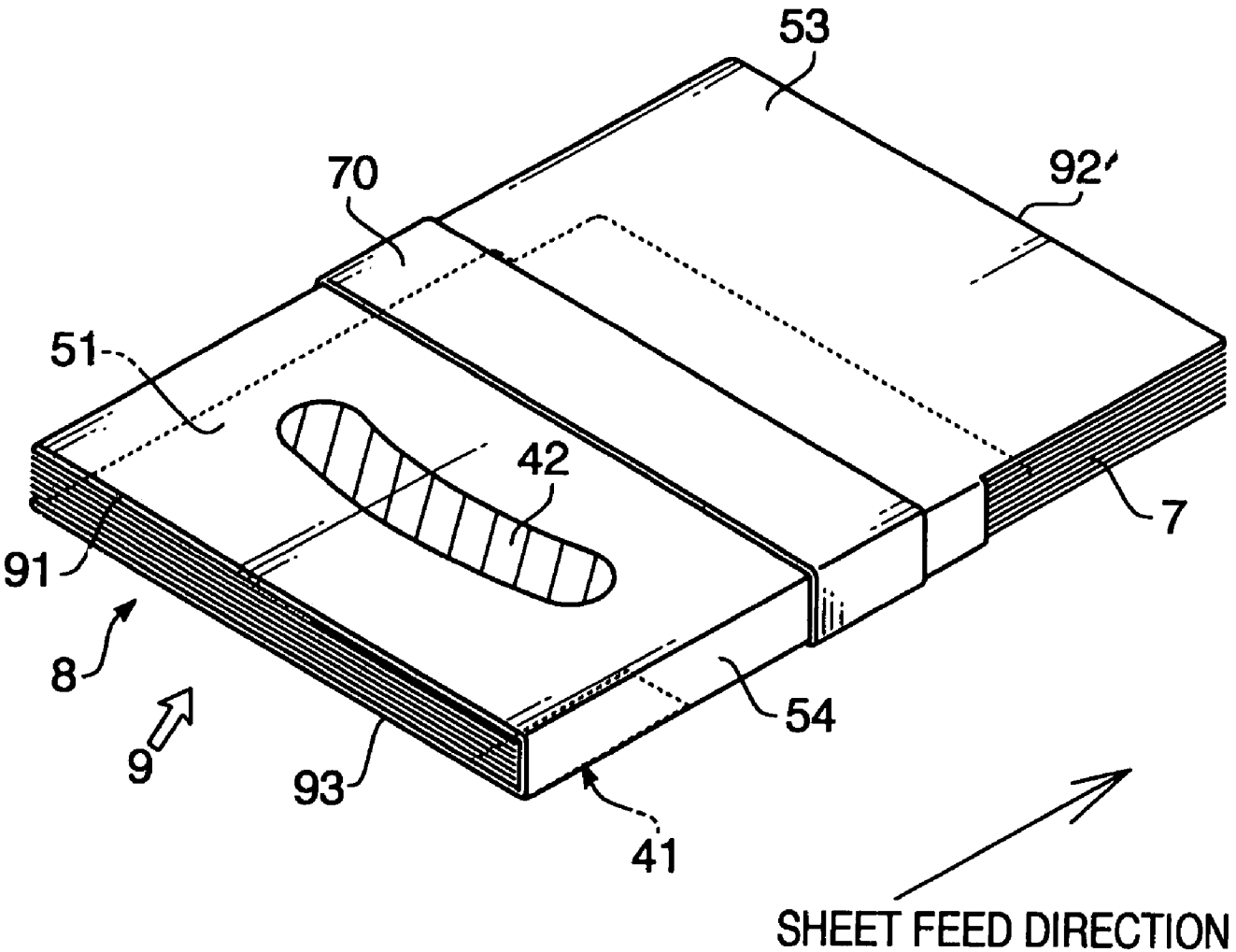
FIG. 16 is a perspective view showing another modification of the sheet package in which the package member has only one side board covering one side edge of the stack of sheets extending in the sheet feed direction.
Figure 17:
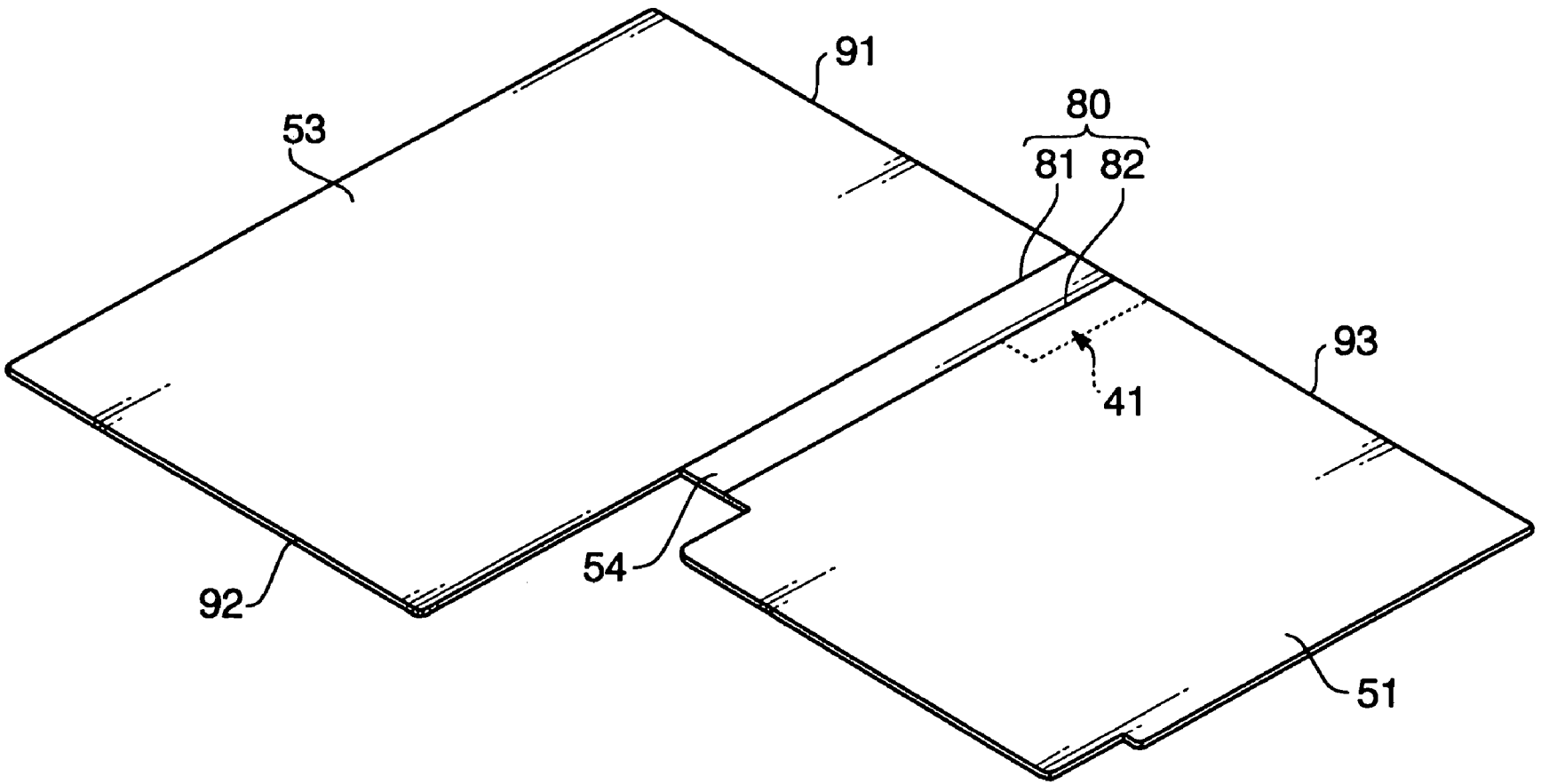
FIG. 17 is a developed view of a package member forming the sheet package of FIG. 16.

It is also possible to remove the side board 52 from the configuration of FIG. 15 to leave only one side board 54 covering one side edge of the sheets 7 extending in the sheet feed direction (see FIG. 16). FIG. 17 is a developed view of the package member 8 of FIG. 16. The package member 8 of FIG. 16 can be formed by folding the top board 53 of the package member 8 of FIG. 17 at the creases 80 (81, 82) so that the top board 53 and the base board 51 face each other.

By configuring the package member 8 to let the side board 54 cover one side edge of the stack of sheets 7 extending in the sheet feed direction, the displacement between the top board 53 and the base board 51 caused by the sheet feed operation can be reduced effectively. By the reduction of the displacement between the top board 53 and the base board 51, the identification mark 41 can be positioned at the reflective sensor 40 more precisely.

Further, a colored sheet may be added between the top board 53 of the package member 8 and the uppermost one of the sheets 7 stacked up in the sheet package 9. The feeding of a sheet other than the sheets 7 can let the user recognize that all the sheet 7 in the printer have been used up.

Therefore, a wasteful sheet feed operation with no sheet 7 remaining in the printer 1 can be avoided and deterioration of the package member 8 (caused by direct contact of the revolving pickup roller 12 with the package member 8) can be prevented. By the prevention of the deterioration of the package member 8, repeated use of the package member 8 is made possible.

INDUSTRIAL APPLICABILITY

By the present invention, a sheet package, allowing easy storing of the sheets in the package member and positioning of the sheets at a proper position in a printer, is provided.

Among sheet packages allowing a stack of sheets to be loaded in a printer together with the package member, the sheet package in accordance with the present invention simplifies the configuration of the package member while preventing the displacement of the package member relative to the printer even in the sheet feed operation.

Further, a package member for the sheet package and a printer that is loaded with the sheet package are also provided by the present invention.

What is claimed is:

1. A sheet package which can be loaded in a sheet storage unit of a printer, comprising:

a stack of sheets as print media for the printer; and a package member covering the exterior of the stack of sheets, wherein:

the package member includes a first portion covering only one of upper and lower faces of the stack of sheets, a second portion connecting with the first portion and covering a side face of the stack of sheets, and a third portion connecting with the second portion and covering the other of the upper and lower faces of the stack of sheets, and the first portion of the package member includes a first exposing portion exposing part of the stack of sheets to allow entrance of a sheet feed roller of the printer, the package member includes a second exposing portion exposing a side part of the stack of sheets facing a pressing member provided to a side wall of the sheet storage unit of the printer parallel to a sheet feed direction so that the pressing member can press the stack of sheets against a positioning portion provided to the opposite side wall of the sheet storage unit parallel to the sheet feed direction, wherein the first portion and the third portion are only connected by the second portion that faces only the side face of the stack of sheets; and a belt shaped member is wound around the package member.

2. The sheet package according to claim 1, wherein the second portion covers a side face of the stack of sheets on an upstream side in the sheet feed direction.

3. The sheet package according to claim 1, wherein the sheets are heat-sensitive sheets.

4. The sheet package according to claim 1, wherein a part of the package member covering the exterior of the stack of sheets consists of the first portion, the second portion and the third portion.

5. The sheet package according to claim 1, wherein lengths of the first portion and the third portion of the package member in a direction orthogonal to the sheet feed direction are equal to a length of the sheet in the direction orthogonal to the sheet feed direction.

6. A sheet package which can be loaded in a sheet storage unit of a printer, comprising:

a stack of sheets as print media for the printer; and a package member covering the exterior of the stack of sheets, wherein:

the package member includes a first portion covering one of upper and lower faces of the stack of sheets, a second portion connecting with the first portion and covering a side face of the stack of sheets, and a third portion connecting with the second portion and covering the other of the upper and lower faces of the stack of sheets, the first portion of the package member includes a first exposing portion exposing part of the stack of sheets to allow entrance of a sheet feed roller of the printer, and the package member includes a second exposing portion exposing a side part of the stack of sheets facing a pressing member provided to a side wall of the sheet storage unit of the printer parallel to a sheet feed direction so that the pressing member can press the stack of sheets against a positioning portion provided to the opposite side wall of the sheet storage unit parallel to the sheet feed direction, wherein the first portion and the third portion are connected by the second portion that faces only the side face of the stack of sheets, wherein the first portion includes an identification part readable to a sensor of the printer, the identification part including:

at least one of colored/uncolored parts colored/uncolored in a prescribed color; and a positioning cut made into the uncolored part in order to form a tab part which can be engaged with the sensor of the printer.

7. A package member covering the exterior of a stack of sheets and being loadable in a sheet storage unit of a printer, wherein:

the package member includes a first portion covering one of upper and lower faces of the stack of sheets, a second portion connecting with the first portion and covering a side face of the stack of sheets, and a third portion connecting with the second portion and covering the other of the upper and lower faces of the stack of sheets, the first portion includes a first exposing portion exposing part of the stack of sheets to allow entrance of a sheet feed roller of the printer, the package member includes a second exposing portion exposing a side part of the stack of sheets facing a pressing member provided to a side wall of the sheet storage unit of the printer parallel to a sheet feed direction so that the pressing member can press the stack of sheets against a positioning portion provided to the opposite side wall of the sheet storage unit parallel to the sheet feed direction, wherein the first portion and the third portion are only connected by the second portion that faces only the side face of the stack of sheets, and a belt shaped member is wound around the package member.

8. A printer comprising:

a sheet package including a stack of sheets as print media and a package member covering the exterior of the stack of sheets;

a sheet storage unit in which the sheet package is loaded; and a sheet feed roller provided to a bottom of the sheet storage unit for feeding the stacked sheets one by one, wherein:

the sheet storage unit includes a positioning portion provided to its one side wall parallel to a sheet feed direction and a pressing member provided to the opposite side wall parallel to the sheet feed direction being biased toward the one side wall, the package member includes a first portion covering one of upper and lower faces of the stack of sheets, a second portion connecting with the first portion and covering a side face of the stack of sheets on an upstream side in the sheet feed direction, and a third portion connecting with the second portion and covering the other of the upper and lower faces of the stack of sheets, the first portion of the package member includes a first exposing portion exposing part of the stack of sheets to allow entrance of the sheet feed roller, and the package member includes a second exposing portion exposing a side part of the stack of sheets facing the pressing member so as to allow pressing by the pressing member.

9. A sheet package which can be loaded in a sheet storage unit of a printer, comprising:

a stack of sheets as print media for the printer; and a package member covering the exterior of the stack of sheets, wherein:

the package member includes a first portion covering one of upper and lower faces of the stack of sheets, a second portion connecting with the first portion and covering a side face of the stack of sheets on an upstream side in a sheet feed direction, and a third portion connecting with the second portion and covering the other of the upper and lower faces of the stack of sheets, the first portion of the package member includes an identification part readable to a sensor unit of the printer and a configuration allowing entrance of a sheet feed roller of the printer, the third portion has edge parts on its upstream side and downstream side in the sheet feed direction, the edge parts being configured to make contact with inner surfaces of the sheet storage unit on its upstream side and downstream side in the sheet feed direction respectively when the sheet package is loaded in the sheet storage unit, and the package member is positioned in the sheet feed direction by the contact of the edge parts of the third portion with the inner surfaces of the sheet storage unit, wherein the first portion and the third portion are only connected by the second portion that faces only the side face of the stack of sheets, and a belt shaped member is wound around the package member.

10. The sheet package according to claim 9, wherein the first portion is formed to be shorter than the third portion in the sheet feed direction in order to allow the entrance of the sheet feed roller.

11. The sheet package according to claim 9, wherein a difference between a distance between the inner surfaces of the sheet storage unit on the upstream side and downstream side in the sheet feed direction and a dimension of the third portion in the sheet feed direction is within 1.0 mm.

12. The sheet package according to claim 9, wherein the second portion of the package member covers a side face of the stack of sheets on the upstream side in the sheet feed direction.

13. The sheet package according to claim 9, wherein the second portion of the package member covers a side face of the stack of sheets extending in the sheet feed direction.

14. The sheet package according to claim 9, wherein the first portion, the second portion and the third portion of the package member are formed integrally.

15. A package member covering the exterior of a stack of sheets and being loadable in a sheet storage unit of a printer, wherein:

the package member includes a first portion covering one of upper and lower faces of the stack of sheets, a second portion connecting with the first portion and covering a side face of the stack of sheets on an upstream side in a sheet feed direction, and a third portion connecting with the second portion and covering the other of the upper and lower faces of the stack of sheets, the first portion includes an identification part readable to a sensor unit of the printer and a configuration allowing entrance of a sheet feed roller of the printer, the third portion has edge parts on its upstream side and downstream side in the sheet feed direction, the edge parts being configured to make contact with inner surfaces of the sheet storage unit on its upstream side and downstream side in the sheet feed direction respectively when the sheet package is loaded in the sheet storage unit, and the package member is positioned in the sheet feed direction by the contact of the edge parts of the third portion with the inner surfaces of the sheet storage unit, wherein the first portion and the third portion are only connected by the second portion that faces only the side face of the stack of sheets, and a belt shaped member is wound around the package member.

16. A printer comprising:

a sheet package including a stack of sheets as print media and a package member covering the exterior of the stack of sheets;

a sheet storage unit in which the sheet package is loaded, the sheet storage unit including a pressing member provided on a side wall of the sheet storage unit parallel to a sheet feed direction and a positioning portion provided on a wall of the sheet package opposite the side wall;

a sensor unit provided to a bottom of the sheet storage unit for identifying the type of the sheets stored in the sheet package; and a sheet feed roller provided to the bottom of the sheet storage unit for feeding the stacked sheets one by one, wherein:

the package member includes a first portion covering one of upper and lower faces of the stack of sheets, a second portion connecting with the first portion and covering a side face of the stack of sheets on an upstream side in the sheet feed direction, and a third portion connecting with the second portion and covering the other of the upper and lower faces of the stack of sheets, the first portion includes an identification part readable to the sensor unit and a configuration allowing entrance of the sheet feed roller, the third portion has edge parts on its upstream side and downstream side in the sheet feed direction, the edge parts being configured to make contact with inner surfaces of the sheet storage unit on its upstream side and downstream side in the sheet feed direction respectively when the sheet package is loaded in the sheet storage unit, the package member is positioned in the sheet feed direction by the contact of the edge parts of the third portion with the inner surfaces of the sheet storage unit, the first portion of the package member includes a first exposing portion exposing part of the stack of sheets to allow entrance of the sheet feed roller of the printer, and the package member includes a second exposing portion exposing a first side part of the stack of sheets and a second side part of the stack of sheets, the first side part facing the pressing member so that the pressing member can press the stack of sheets so that the second side part is positioned along the positioning portion.

* * * * *